US007076185B2

(12) United States Patent
Okamoto

(10) Patent No.: US 7,076,185 B2
(45) Date of Patent: Jul. 11, 2006

(54) DEVELOPING DEVICE, IMAGE FORMING APPARATUS, COMPUTER SYSTEM, AND SEAL-ASSISTING MEMBER

(75) Inventor: Katsumi Okamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 46 days.

(21) Appl. No.: 10/930,698

(22) Filed: Aug. 31, 2004

(65) Prior Publication Data

US 2005/0063729 A1 Mar. 24, 2005

(30) Foreign Application Priority Data

Sep. 10, 2003 (JP) ..... 2003-318721

(51) Int. Cl.
*G03G 15/08* (2006.01)

(52) U.S. Cl. ..... 399/103; 399/105; 399/109

(58) Field of Classification Search ..... 399/102, 399/103, 105, 106, 109, 119
See application file for complete search history.

(56) References Cited

U.S. PATENT DOCUMENTS 5,177,536 A 1/1993 Watanabe et al.

FOREIGN PATENT DOCUMENTS

| | | |
|---|---|---|
| EP | 1 096 335 | 5/2001 |
| EP | 1 130 481 | 9/2001 |
| JP | 63-038969 | 2/1988 |
| JP | 5-29114 | 4/1993 |
| JP | 05-029114 | 4/1993 |
| JP | 07-146613 | 6/1995 |
| JP | 11-167283 | 6/1999 |
| JP | 2000-242079 | 9/2000 |
| JP | 2001-051563 | 2/2001 |

*Primary Examiner*—Hoang Ngo

(74) *Attorney, Agent, or Firm*—Hogan & Hartson LLP

(57) ABSTRACT

A developing device is provided with a developer containing section for containing developer; a developing roller for bearing the developer; a restriction blade for restricting the developer bore by the developing roller; an end seal for preventing the developer from spilling through a gap between an end of the restriction blade and the developer containing section and for preventing the developer from spilling through a gap between an end of the developing roller and the developer containing section; and a seal-assisting member for pressing the end seal against the end surface of the restriction blade.

8 Claims, 13 Drawing Sheets

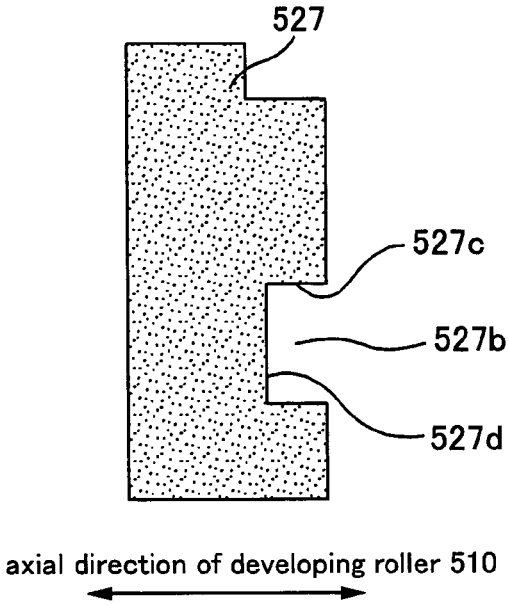
FIG. 8
FIG. 9
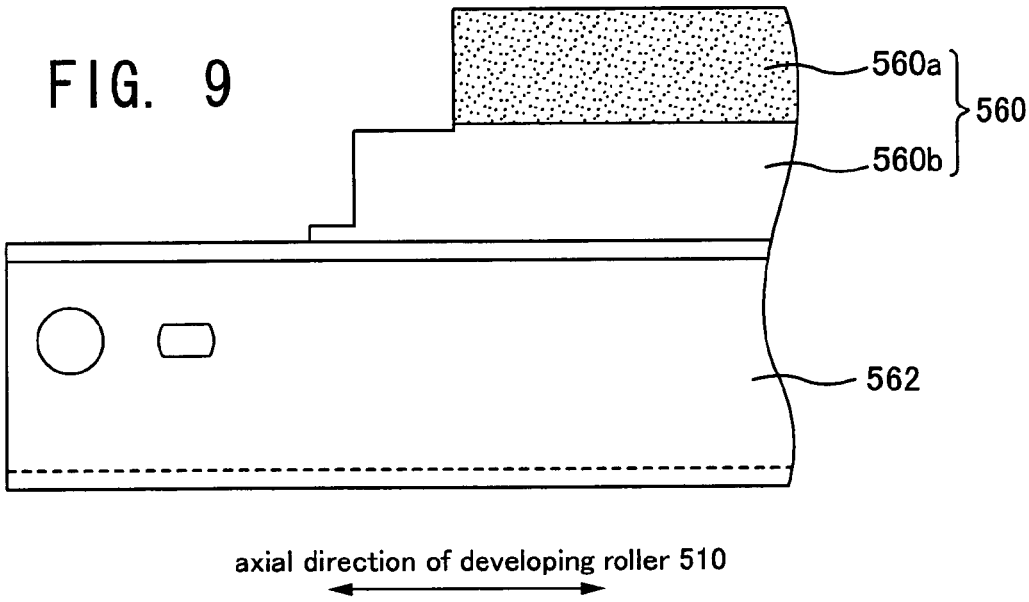

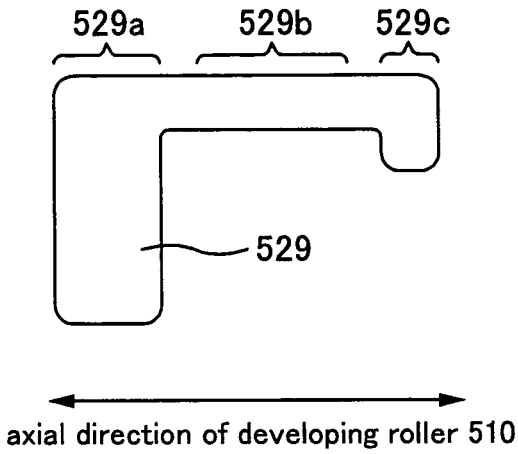
FIG. 10
FIG. 11
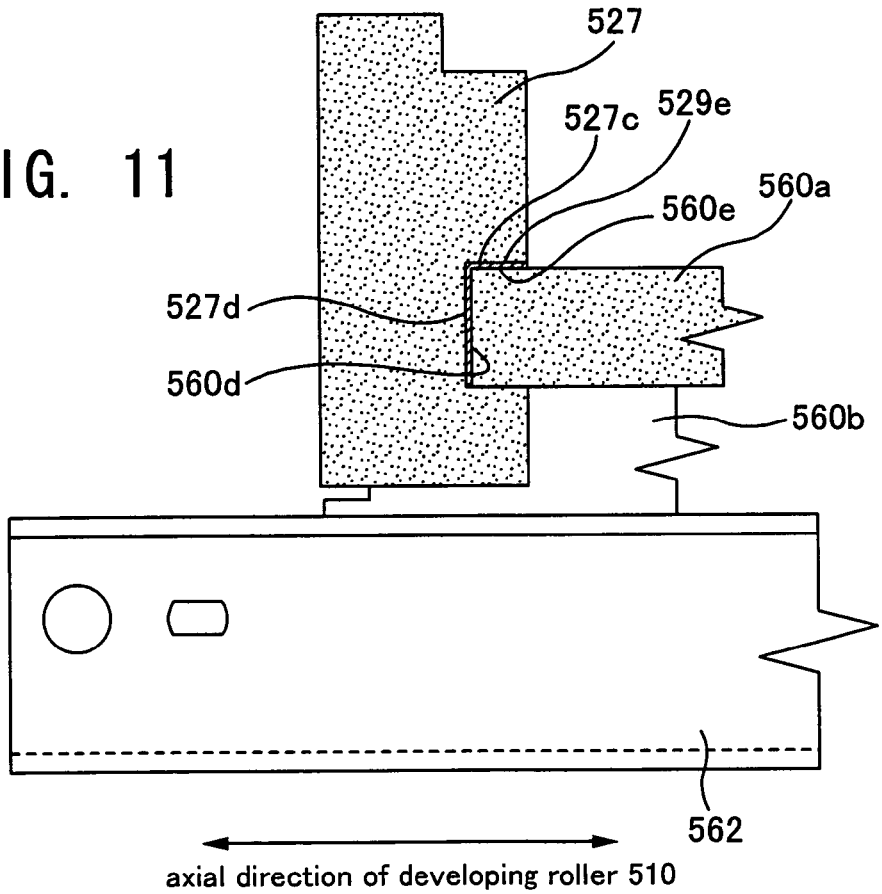

DEVELOPING DEVICE, IMAGE FORMING APPARATUS, COMPUTER SYSTEM, AND SEAL-ASSISTING MEMBER

CROSS-REFERENCE TO RELATED APPLICATIONS

The present application claims priority upon Japanese Patent Application No. 2003-318721 filed Sep. 10, 2003, which is herein incorporated by reference.

BACKGROUND OF THE INVENTION

1. Field of the Invention

The present invention relates to developing devices, image forming apparatuses, computer systems, and seal-assisting members.

2. Description of the Related Art

Developing devices that develop latent images formed on a photoconductor using toner, which serves as developer, are known as an example of developing devices provided in image forming apparatuses. In such developing devices, a developing roller is made to oppose a photoconductor in order to supply the toner to the photoconductor by means of the developing roller. In order to achieve this, it is necessary to provide an opening in a housing, which serves as a toner containing section for containing the toner, to allow the developing roller to be exposed to the outside.

If, however, such an opening is provided in the housing which contains the toner, the toner may spill from a gap formed between the developing roller and the housing, or from a gap formed between a restriction blade and the housing.

In order to prevent the toner from spilling, end seals are provided at the ends of the developing roller and the restriction blade as sealing members for preventing the toner from spilling. (See, for example, Japanese Patent Application Examined Publication (Kohyo) No. 5-29114.)

However, although the restriction blade and the end seal are both pressed against the developing roller, they differ in thickness and material from which they are formed. This tends to give rise to a gap being formed between the end seal and the side end surface of the restriction blade.

SUMMARY OF THE INVENTION

The present invention has been made in view of the issues described above, and an object thereof is to achieve a developing device that has a sealing structure which is less prone to causing toner spilling, an image forming apparatus provided with such a developing device, a computer system provided with such an image forming apparatus, and a seal-assisting member.

An aspect of the present invention for resolving the above issues is a developing device comprising: a developer containing section for containing developer; a developing roller for bearing the developer; a restriction blade for restricting the developer bore by the developing roller; an end seal for preventing the developer from spilling through a gap between an end of the restriction blade and the developer containing section and for preventing the developer from spilling through a gap between an end of the developing roller and the developer containing section; and a seal-assisting member for pressing the end seal against the end surface of the restriction blade.

Features and objects of the present invention other than the above will become clear through the present specification and the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 8 is a diagram showing the structure of an end seal 527;

FIG. 9 is a diagram showing a restriction blade 560 and a blade-supporting metal plate 562;

FIG. 10 is a diagram showing a seal-assisting member 529;

FIG. 11 is a diagram, viewed from the side of the developing roller 510, showing a state in which the end seals 527, the restriction blade 560, and the blade-supporting metal plate 562 have been assembled together;

DETAILED DESCRIPTION OF THE INVENTION

Figure 1:
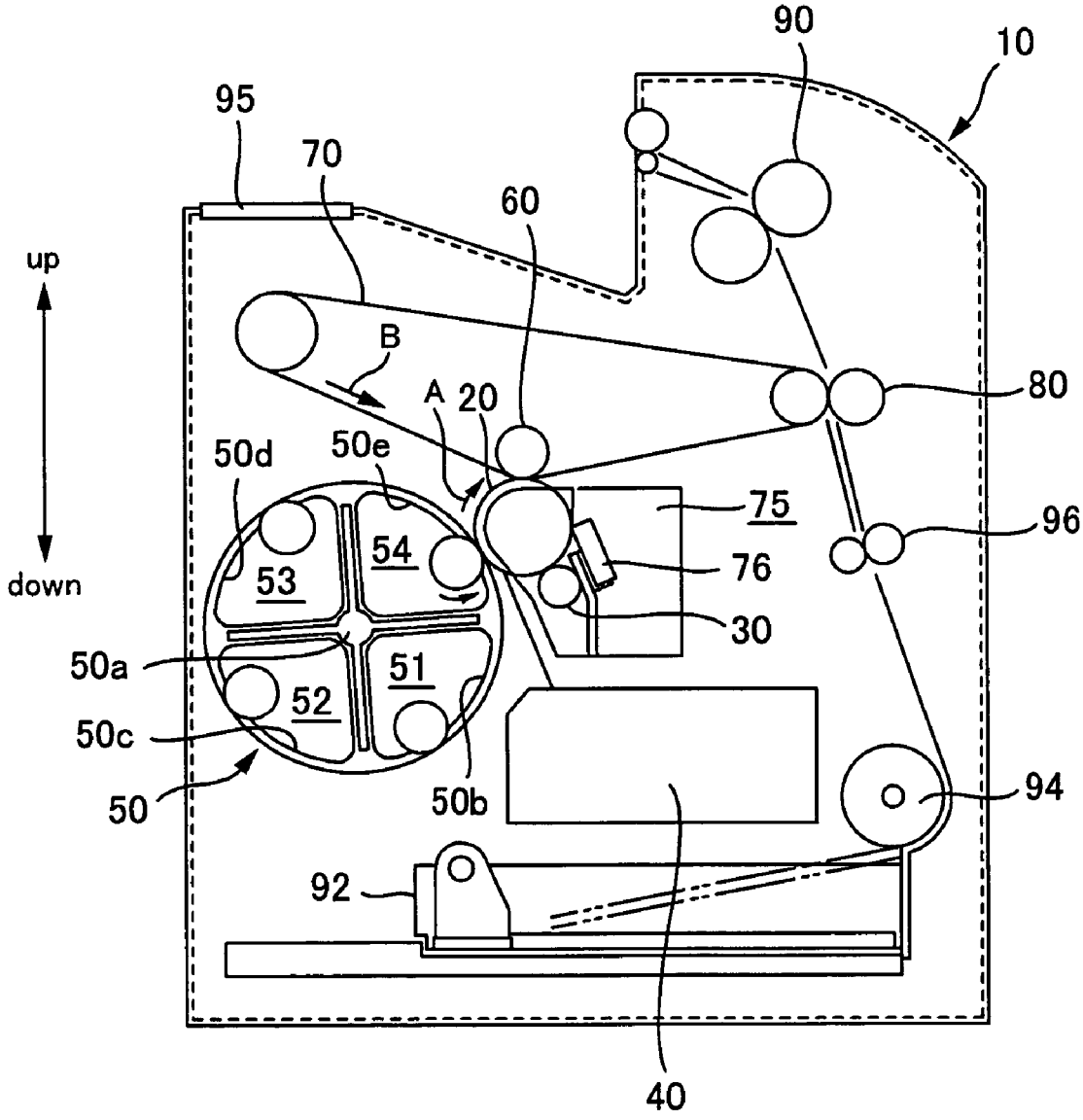
FIG. 1 is a diagram showing main structural components structuring an image forming apparatus according to an embodiment of the present invention.

At least the following matters will be made clear by the description in the present specification and the description of the accompanying drawings.

An aspect of the present invention is a developing device comprising: a developer containing section for containing developer; a developing roller for bearing the developer; a restriction blade for restricting the developer bore by the developing roller; an end seal for preventing the developer from spilling through a gap between an end of the restriction blade and the developer containing section and for preventing the developer from spilling through a gap between an end of the developing roller and the developer containing section; and a seal-assisting member for pressing the end seal against the end surface of the restriction blade.

According to such a developing device, since a seal-assisting member for pressing the end seal against the end surface of the restriction blade, it becomes possible to effectively prevent the developer from spilling through a gap between the developer containing section and the end of the restriction blade.

Further, in the above-described developing device: a sealing unit is provided with the restriction blade and the end seal, the restriction blade being in an unbent state and the end seal abutting against the end surface of the restriction blade in a non-compressed state before the sealing unit is assembled with a housing and the developing roller; and when the sealing unit is assembled with the housing and the developing roller, the restriction blade is brought into a bent state to abut against the developing roller and the end seal is brought into a compressed state to prevent the developer from spilling.

According to such a developing device, it is possible to effectively prevent the developer from spilling through a gap between the developer containing section and the end of the restriction blade by virtue of the seal-assisting member, even when a sealing unit, which is provided with the restriction blade in an unbent state and the end seal in a non-compressed state, is assembled with the housing and the developing roller and whereby the restriction blade bends and the end seal is compressed.

Further, in the above-described developing device: the restriction blade and one side of the end seal abut against the developing roller; the restriction blade and the other side of the end seal abut against the housing, an elastic member being arranged between the housing, and the restriction blade and the other side of the end seal; and before the sealing unit is assembled with the housing and the developing roller, the thickness of the restriction blade and the thickness of the end seal differ from one another.

In such a developing device, a gap is likely to be formed between the end surface of the restriction blade and the end seal when the restriction blade bends and the end seal is compressed, because the restriction blade and one side of the end seal abut against the developing roller, the restriction blade and the other side of the end seal abut against the housing with an elastic member being arranged between the housing and the restriction blade and the other side of the end seal, and the thickness of the restriction blade and the thickness of the end seal differ from one another before the sealing unit is assembled with the housing and the developing roller. However, by providing the seal-assisting member for pressing the end seal against the end surface of the restriction blade, it becomes possible to effectively prevent the gap from being formed between the end seal and the end surface of the restriction blade, even in a developing device that is prone to causing spilling.

Further, in the above-described developing device: the restriction blade and one side of the end seal abut against the developing roller; the restriction blade and the other side of the end seal abut against the housing, an elastic member being arranged between the housing, and the restriction blade and the other side of the end seal; and the material from which the restriction blade is made and the material from which the end seal is made differ from one another.

In such a developing device, a gap is likely to be formed between the end surface of the restriction blade and the end seal when the restriction blade bends and the end seal is compressed, because the restriction blade and one side of the end seal abut against the developing roller, the restriction blade and the other side of the end seal abut against the housing with an elastic member being arranged between the housing and the restriction blade and the other side of the end seal, and the material from which the restriction blade is made and the material from which the end seal is made differ from one another. However, by providing the seal-assisting member for pressing the end seal against the end surface of the restriction blade, it becomes possible to effectively prevent the gap from being formed between the end seal and the end surface of the restriction blade, even in a developing device that is prone to causing spilling.

Further, in the above-described developing device, the seal-assisting member is made of a flexible material.

According to such a developing device, it is possible to fold the seal-assisting member and wrap it along the outer shape of the end seal, without forming any gap, upon assembling the seal-assisting member.

Further, in the above-described developing device, one end of the seal-assisting member is fixed to the restriction blade, and the other end of the seal-assisting member is fixed to the end seal.

According to such a developing device, by fixing one end of the seal-assisting member to the restriction blade and the other end to the end seal, it becomes possible to cause the end seal to abut against the side end surface of the restriction blade effectively.

Further, in the above-described developing device, one end of the seal-assisting member is fixed to the restriction blade, the seal-assisting member is folded at an intermediate section to surround the side end of the end seal, and the other end of the seal-assisting member is fixed to the end seal.

According to such a developing device, by fixing one end of the seal-assisting member to the restriction blade, folding the seal-assisting member at an intermediate section to surround the side end of the end seal, and fixing the other end to the end seal, it becomes possible to cause the end seal to abut against the side end surface of the restriction blade more effectively.

Further, in the above-described developing device, the width of a folding section of the seal-assisting member which is folded to surround the side end of the end seal is smaller than the width of the one end and the width of the other end of the seal-assisting member.

According to such a developing device, since the width of a folding section of the seal-assisting member, which is folded to surround the side end of the end seal, is smaller than the width of the one end and the width of the other end of the seal-assisting member, the seal-assisting member becomes linear when tension is applied thereto and slackness in the seal-assisting member is less prone to occurring, even if there is somewhat of a misalignment in position. Therefore, it becomes possible to cause the end seal to abut against the side end surface of the restriction blade even more effectively.

Further, in the above-described developing device, the seal-assisting member compresses and deforms the end seal with the folding section.

According to such a developing device, since the seal-assisting member compresses and deforms the end seal with the folding section, it is possible to confirm, at a glance, that a compressing force is being applied to the end seal, and easily get hold of the compression state of the end seal.

Therefore, the possibility that defective items are manufactured can be reduced, and assembly inspections become easy.

Further, in the above-described developing device, the seal-assisting member has an L-shaped section or a T-shaped section in at least either one of the one end and the other end.

According to such a developing device, since the seal-assisting member has an L-shaped section or a T-shaped section in at least either one of the one end and the other end, it is possible to make the area for fixing the end of the seal-assisting member large, and therefore stabilize the fixing state thereof.

Further, in the above-described developing device, the one end of the seal-assisting member is fixed to the restriction blade with a double-faced tape.

According to such a developing device, by fixing the one end of the seal-assisting member to the restriction blade with a double-faced tape, it becomes possible to assemble the developing device quickly and certainly.

Further, in the above-described developing device, the seal-assisting member is made of a film-like material, and more preferably, the seal-assisting member is made of PET film.

According to such a developing device, it becomes possible to assemble the seal-assisting member easily as well as cause the end seal to abut against the side end surface of the restriction blade effectively.

Further, in the above-described developing device, the seal-assisting member is provided in a position where it does not come into contact with the developing roller.

According to such a developing device, since the seal-assisting member is provided in a position where it does not come into contact with the developing roller, the seal-assisting member does not come into contact with the developing roller. Therefore, the seal-assisting member will not roll up or peel off by the frictional force caused by coming into contact with the developing roller. Accordingly, it becomes possible to cause the end seal to abut against the side end surface of the restriction blade stably.

It is also possible to achieve a developing device comprising: a developer containing section for containing developer; a developing roller for bearing the developer; a restriction blade for restricting the developer bore by the developing roller; an end seal for preventing the developer from spilling through a gap between an end of the restriction blade and the developer containing section and for preventing the developer from spilling through a gap between an end of the developing roller and the developer containing section; and a seal-assisting member for pressing the end seal against the end surface of the restriction blade, wherein: a sealing unit is provided with the restriction blade and the end seal, the restriction blade being in an unbent state and the end seal abutting against the end surface of the restriction blade in a non-compressed state before the sealing unit is assembled with a housing and the developing roller; when the sealing unit is assembled with the housing and the developing roller, the restriction blade is brought into a bent state to abut against the developing roller and the end seal is brought into a compressed state to prevent the developer from spilling; the restriction blade and one side of the end seal abut against the developing roller; the restriction blade and the other side of the end seal abut against the housing, an elastic member being arranged between the housing, and the restriction blade and the other side of the end seal; before the sealing unit is assembled with the housing and the developing roller, the thickness of the restriction blade and the thickness of the end seal differ from one another; the material from which the restriction blade is made and the material from which the end seal is made differ from one another; the one end of the seal-assisting member is fixed to the restriction blade, the seal-assisting member is folded at an intermediate section to surround the side end of the end seal, and the other end of the seal-assisting member is fixed to the end seal; the width of a folding section of the seal-assisting member which is folded to surround the side end of the end seal is smaller than the width of the one end and the width of the other end of the seal-assisting member; the seal-assisting member compresses and deforms the end seal with the folding section; the seal-assisting member has an L-shaped section or a T-shaped section in at least either one of the one end and the other end; the seal-assisting member is made of a film-like material; and the seal-assisting member is provided in a position where it does not come into contact with the developing roller.

Another aspect of the present invention is an image forming apparatus comprising a developing device that is provided with: a developer containing section for containing developer; a developing roller for bearing the developer; a restriction blade for restricting the developer bore by the developing roller; an end seal for preventing the developer from spilling through a gap between an end of the restriction blade and the developer containing section and for preventing the developer from spilling through a gap between an end of the developing roller and the developer containing section; and a seal-assisting member for pressing the end seal against the end surface of the restriction blade.

According to such an image forming apparatus, it becomes possible to achieve an image forming apparatus that is less prone to getting dirty and thus is superior to conventional apparatuses by being provided with a developing device that is less prone to developer spilling.

Another aspect of the present invention is a computer system comprising: a computer; and an image forming apparatus that is connected to the computer and that is provided with: a developer containing section for containing developer; a developing roller for bearing the developer; a restriction blade for restricting the developer bore by the developing roller; an end seal for preventing the developer from spilling through a gap between an end of the restriction blade and the developer containing section and for preventing the developer from spilling through a gap between an end of the developing roller and the developer containing section; and a seal-assisting member for pressing the end seal against the end surface of the restriction blade.

According to such a computer system, it becomes possible to achieve a computer system that is less prone to getting dirty and thus is superior to conventional systems by being provided with a developing device that is less prone to developer spilling.

It is also possible to achieve a seal-assisting member for pressing an end seal, which is for preventing developer from spilling through a gap between a developer containing section and an end of a restriction blade that restricts the developer bore by a developing roller and which is for preventing the developer from spilling through a gap between an end of the developing roller and the developer containing section, against the end surface of the restriction blade, wherein the seal-assisting member compresses and deforms the end seal.

Overview of Image Forming Apparatus (Laser-beam Printer)

With reference to FIG. 1, an outline of an image forming apparatus will be described, taking a laser-beam printer 10

(hereinafter referred to as "printer") as an example. FIG. 1 is a diagram showing main structural components constructing the printer 10.

It should be noted that in FIG. 1, the vertical direction is shown by the arrow; for example, a paper supply tray 92 is arranged at a lower section of the printer 10, and a fusing unit 90 is arranged at an upper section of the printer 10.

As shown in FIG. 1, the printer 10 according to the present embodiment has a charging unit 30, an exposing unit 40, a YMCK developing device 50, a first transferring unit 60, an intermediate transferring body 70, and a cleaning unit 75, all of which being arranged in the direction of rotation of a photoconductor 20 serving as a latent-image bearing body for bearing a latent image. The printer 10 further includes: a second transferring unit 80; a fusing unit 90; a displaying unit 95 made of a liquid-crystal panel and serving as means for making notifications to a user; and a control unit 100 (FIG. 2) for controlling each of these units etc. and managing their operations as a printer.

The photoconductor 20 has a cylindrical conductive base and a photoconductive layer formed on the outer peripheral surface of the conductive base, and it is rotatable about its central axis. In the present embodiment, the photoconductor 20 rotates clockwise, as shown by the arrow A in FIG. 1.

The charging unit 30 is a device for charging the photoconductor 20. The exposing unit 40 is a device for forming a latent image on the charged photoconductor 20 by radiating a laser beam thereon.

The exposing unit 40 has, for example, a semiconductor laser, a polygon mirror, and an F-θ lens, and radiates a modulated laser beam onto the charged photoconductor 20 according to image signals that have been input from a not-shown host computer such as a personal computer or a word processor.

The YMCK developing device 50 is a device for developing the latent image formed on the photoconductor 20 using black (K) toner, magenta (M) toner, cyan (C) toner, and yellow (Y) toner, which serve as the developer.

The toner of each color is contained, respectively, in a black developing device 51, a magenta developing device 52, a cyan developing device 53, and a yellow developing device 54 of the YMCK developing device 50.

In the present embodiment, the YMCK developing device 50 rotates to allow the positions of the four developing devices 51, 52, 53, and 54 to be moved.

More specifically, the YMCK developing device 50 holds the four developing devices 51, 52, 53, and 54 with four holding sections 50*b*, 50*c*, 50*d*, and 50*e*, and the four developing devices 51, 52, 53, and 54 are configured such that they are rotatable about a central shaft 50*a* while maintaining their relative positions. By making each of the developing devices 51, 52, 53, and 54 that corresponds to the latent image formed on the photoconductor 20 selectively oppose the photoconductor 20, the latent image on the photoconductor 20 is developed by the toner contained in each of the developing devices 51, 52, 53, and 54.

It should be noted that details on the developing devices will be described further below.

The first transferring unit 60 is a device for transferring a single-color toner image formed on the photoconductor 20 onto the intermediate transferring body 70. When the toners of all four colors are successively transferred in a superimposing manner, a full-color toner image will be formed on the intermediate transferring body 70.

The intermediate transferring body 70 is an endless belt that is driven to rotate in the direction show by the arrow B at substantially the same circumferential speed as the photoconductor 20. The second transferring unit 80 is a device for transferring the single-color toner image or the full-color toner image formed on the intermediate transferring body 70 onto a recording medium such as paper, film, and cloth.

The fusing unit 90 is a device for fusing the single-color toner image or the full-color toner image, which has been transferred onto the recording medium such as paper, to the recording medium to make it into a permanent image.

The cleaning unit 75 is a device that is provided between the first transferring unit 60 and the charging unit 30, that has a rubber cleaning blade 76 made to abut against the surface of the photoconductor 20, and that is for removing the toner remaining on the photoconductor 20 by scraping it off with the cleaning blade 76 after the toner image has been transferred onto the intermediate transferring body 70 by the first transferring unit 60.

Figure 2:
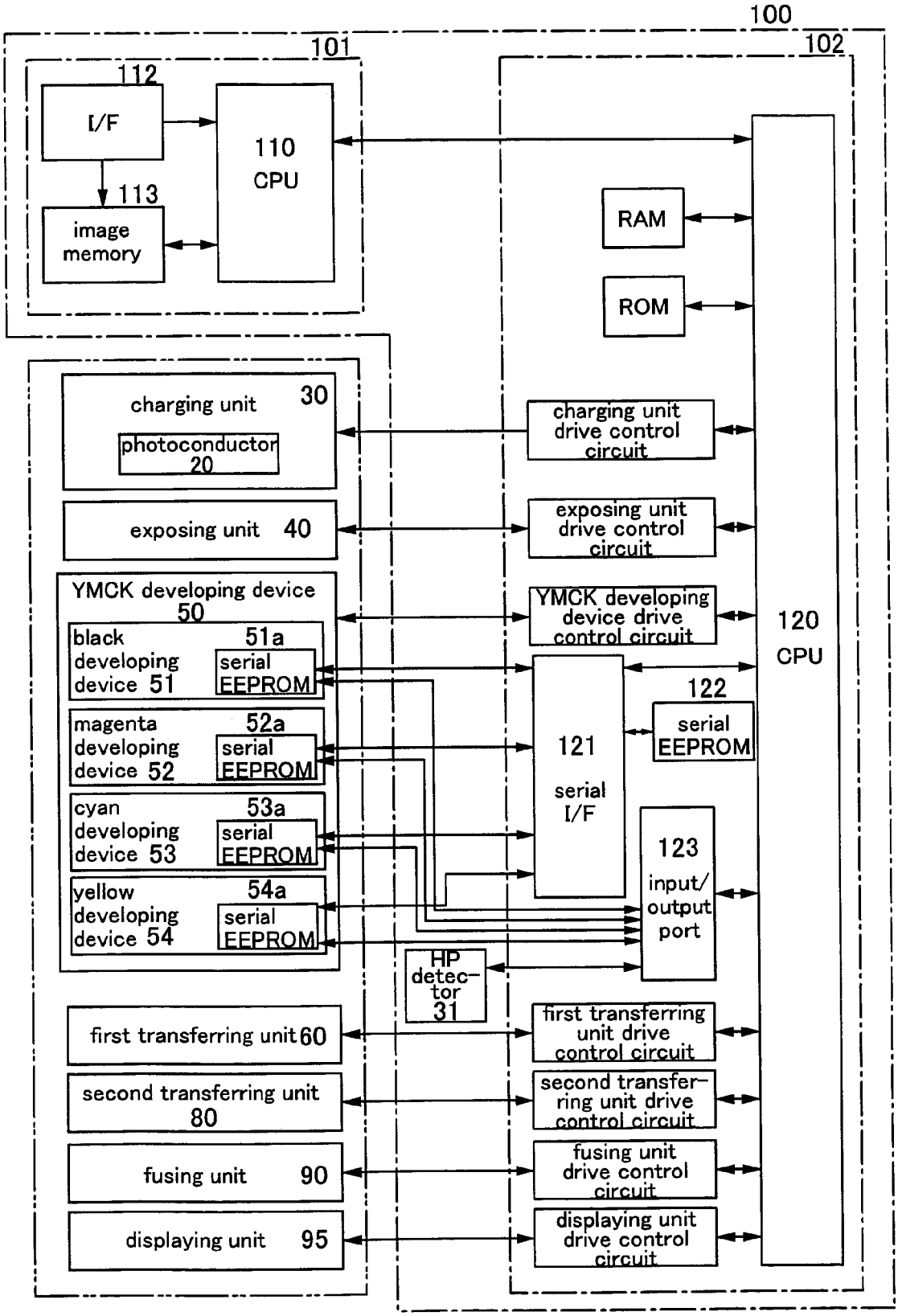
FIG. 2 is a block diagram showing a control unit in the image forming apparatus of FIG. 1.

As shown in FIG. 2, the control unit 100 comprises a main controller 101 and a unit controller 102. Image signals are input to the main controller 101, and according to commands that are given based on these image signals, the unit controller 102 controls the above-mentioned units etc. to form an image.

Operations of Printer 10

Next, operations of the printer 10 structured as above will be described with reference to other structural components.

First, when an image signal is input from the not-shown host computer to the main controller 101 of the printer 10 through an interface (I/F) 112, then, under the control of the unit controller 102 based on the commands from the main controller 101, the photoconductor 20, a developing roller 510 (FIG. 3) provided in the developing device as a developing roller, and the intermediate transferring body 70 move to rotate in the direction shown by the arrow B.

While being rotated, the photoconductor 20 is successively charged by the charging unit 30 at a charging position.

At this time, with the rotation of the photoconductor 20, the charged area of the photoconductor 20 reaches an exposing position, and a latent image that corresponds to the image information for the first color, for example yellow Y, is formed in that area by the exposing unit 40. Further, as for the YMCK developing device 50, the yellow developing device 54, which contains yellow (Y) toner, is positioned in the developing position where the yellow developing device 54 opposes the photoconductor 20.

With the rotation of the photoconductor 20, the latent image formed on the photoconductor 20 reaches the developing position, and is developed with the yellow toner by the yellow developing device 54. Thus, a yellow toner image is formed on the photoconductor 20.

With the rotation of the photoconductor 20, the yellow toner image formed on the photoconductor 20 reaches a first transferring position, and is transferred onto the intermediate transferring body 70 by the first transferring unit 60. At this time, a first transferring voltage, which is in an opposite polarity to the polarity to which the toner is charged, is applied to the first transferring unit 60.

It should be noted that, during the above-mentioned processes, the second transferring unit 80 is kept separated from the intermediate transferring body 70.

By repeating the above-mentioned processes for the second, the third, and the fourth colors, toner images in each of the four colors corresponding to the respective image signals are transferred to the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a recording medium by the second transferring unit 80.

It should be noted that the recording medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the recording medium is heated and pressurized by the fusing unit 90 and fused to the recording medium.

On the other hand, after the photoconductor 20 passes the first transferring position, the toner adhering to the surface of the photoconductor 20 is scraped off by the cleaning blade 76 of the cleaning unit 75, and the photoconductor 20 is prepared for charging for forming a next latent image. The scraped-off toner is collected in a remaining-toner collector of the cleaning unit 75.

Overview of Control Unit

Next, with reference to FIG. 2, the configuration of the control unit 100 is described.

The main controller 101 of the control unit 100 is connected to a host computer via the interface 112 and a CPU 110.

The main controller 101 has an image memory 113 for storing image signals that have been input from the host computer. The unit controller 102 is electrically connected to each of the units in the apparatus (i.e., the charging unit 30, the exposing unit 40, the first transferring unit 60, the cleaning unit 75, the second transferring unit 80, the fusing unit 90, and the displaying unit 95) and the YMCK developing device 50.

The unit controller 102 controls the units and the YMCK developing device 50 according to signals received from the main controller 101 while detecting the state of each of the units and the YMCK developing device 50 by receiving signals from sensors provided in each unit.

Further, a CPU 120 of the unit controller 102 is connected, via a serial interface (I/F) 121, to a non-volatile storage element 122 (which is referred to below as "apparatus-side memory") which is, for example, a serial EEPROM.

The CPU 120 is not only connected to the apparatus-side memory 122, but is also connected to the developing-unit-side memories 51*a*, 52*a*, 53*a*, and 54*a*, which are provided on the respective developing devices 51, 52, 53, and 54, via the serial interface 121.

In this way, data can be exchanged between the apparatus-side memory 122 and the developing-unit-side memories 51*a*, 52*a*, 53*a*, and 54*a*, and also, it is possible to input chip-select signals CS to the developing-unit-side memories 51*a*, 52*a*, 53*a*, and 54*a* via an input/output port 123. The CPU 120 is also connected to an HP detector 31 via this input/output port 123.

Overview of Developing Device

Figure 3:
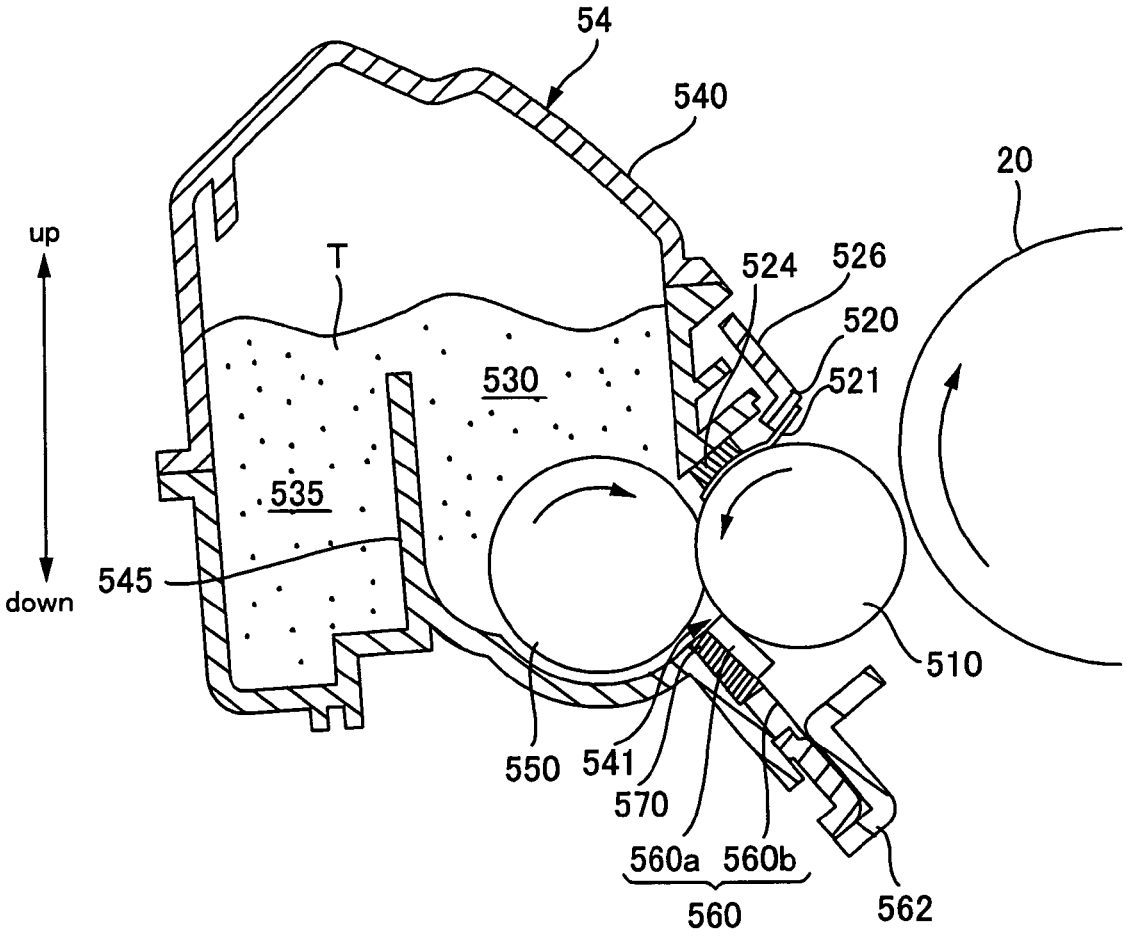
FIG. 3 is a section view for illustrating operations of a developing device

Next, with reference to FIG. 3, an overview of the developing device will be described. FIG. 3 is a section view showing main structural components of the developing device.

It should be noted that, in FIG. 3, the arrow indicates the vertical direction as in FIG. 1, and for example, the central axis of the developing roller 510 is located below the central axis of the photoconductor 20.

Further, FIG. 3 shows a state in which the yellow developing device 54 is located at the developing position opposing the photoconductor 20.

As shown in FIG. 1, the YMCK developing device 50 has: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, description will be made only of the yellow developing device 54 with reference to FIG. 3.

FIG. 3 shows the yellow developing device 54 having a developing roller 510, a toner-supplying roller 550 for supplying toner T to the developing roller 510, a restriction blade 560 for restricting the thickness of the layer of toner T bore by the developing roller 510, and a sealing unit 520 provided with various sealing members. These components are provided in a housing 540 containing yellow toner T, which serves as the developer.

The housing 540 is made by welding together, for example, an upper housing and a lower housing that are integrally molded. The interior of the housing 540 is divided into a first containing section 530 and a second containing section 535 by a restriction wall 545 that extends upward (the vertical direction in FIG. 3) from the bottom portion of the housing 540. The upper section of the first containing section 530 and the second containing section 535 are connected, and the restriction wall 545 restricts the movement of the toner T. The first containing section 530 and the second containing section 535 together form a developer containing section.

It should be noted that the first containing section 530 and the second containing section 535 may be provided with a stirring member for stirring the toner T contained therein. In the present embodiment, however, the developing devices (i.e., the black developing device 51, the magenta developing device 52, the cyan developing device 53, and the yellow developing device 54) rotate along with the rotation of the YMCK developing device 50.

Since the toner T in each developing device is stirred through this rotation, no stirring member is provided in the first containing section 530 and the second containing section 535.

An opening 541 that opens toward the outside of the housing 540 is provided at the lower section of the first containing section 530. The toner-supplying roller 550 is provided in the first containing section 530 in such a manner that its circumferential surface faces the opening 541 and that it is rotatably supported on the housing 540.

The developing roller 510 is arranged from the outside of the housing 540 in such a manner that its circumferential surface faces the opening 541. The toner-supplying roller 550 and the restriction blade 560 press and abut against the developing roller 510.

It should be noted that the sealing unit 520, which includes this restriction blade 560, is provided at the opening 541 so as to prevent the toner from escaping from between the developing roller 510 and the housing 540 that forms the opening 541. The configuration of the sealing unit 520 and its sealing structure are described further below.

The developing roller 510 bears the toner T and delivers it to the developing position opposing the photoconductor 20. The developing roller 510 is made of, for example, aluminum, stainless steel, or iron. If necessary, the roller 510 is plated with, for example, nickel plating or chromium plating, and the toner bearing region of the roller 510 is subjected to sandblasting, for example.

Further, the developing roller 510 is rotatable about its central axis, and as shown in FIG. 3, the developing roller 510 rotates in the opposite direction (counterclockwise in FIG. 3) from the rotating direction of the photoconductor 20 (clockwise in FIG. 3). The central axis of the roller 510 is located below the central axis of the photoconductor 20. Further, as shown in FIG. 3, in a state where the yellow developing device 54 opposes the photoconductor 20, a gap exists between the developing roller 510 and the photoconductor 20.

That is, the yellow developing device 54 develops the latent image formed on the photoconductor 20 in a non-contacting state. It should be noted that an alternating electric field is generated between the developing roller 510 and the photoconductor 20 upon developing the latent image formed on the photoconductor 20.

The toner-supplying roller 550 supplies the toner T contained in the first containing section 530 and the second containing section 535 to the developing roller 510. The toner-supplying roller 550 is made of, for example, polyurethane foam, and is made to abut against the developing roller 510 in an elastically deformed state. The toner-supplying roller 550 is arranged at a lower section of the first containing section 530. The toner T contained in the first containing section 530 and the second containing section 535 is supplied to the developing roller 510 by the toner-supplying roller 550 at the lower section of the first containing section 530.

The toner-supplying roller 550 is rotatable about its central axis. The central axis of the toner-supplying roller 550 is situated below the central axis of rotation of the developing roller 510. Further, the toner-supplying roller 550 rotates in the opposite direction (clockwise in FIG. 3) from the rotating direction of the developing roller 510 (counterclockwise in FIG. 3).

It should be noted that the toner-supplying roller 550 has the function of supplying the toner T contained in the first containing section 530 and the second containing section 535 to the developing roller 510 as well as the function of stripping off the toner T, which remains on the developing roller 510 after development, from the developing roller 510.

The restriction blade 560 restricts the thickness of the layer of the toner T bore by the developing roller 510 and also gives charge to the toner T bore by the developing roller 510. Further, the restriction blade 560 functions as a sealing member on the upstream side of the developing position in the rotating direction of the developing roller 510.

The restriction blade 560 has a rubber section 560*a*, which serves as an abutting member that abuts against the developing roller 510 along its axial direction, and a rubber-supporting section 560*b*, which serves as a supporting member for supporting the rubber section 560*a*.

The rubber section 560*a* is made of, for example, silicone rubber or urethane rubber. A thin, sheet-like plate that is made of, for example, phosphor bronze or stainless steel and that has a springy characteristic, is used as the rubber-supporting section 560*b*, in order for the rubber-supporting section 560*b* to achieve the function of urging the rubber section 560*a* toward the developing roller 510.

One end of the rubber-supporting section 560*b* is fixed to a blade-supporting metal plate 562.

The blade-supporting metal plate 562 is fixed to a sealing frame 526 (described further below) to form a portion of the sealing unit 520 (also described further below) together with the restriction blade 560, and is attached to the housing 540.

In a state where the sealing unit 520 is attached to the housing 540 and the developing roller 510 is attached to the developing device, the rubber section 560*a* is pressed against the developing roller 510 by the elastic force caused by the flexure of the rubber-supporting section 560*b*.

Further, a blade-backing member 570 is provided on one side of the restriction blade 560 opposite from the side of the developing roller 510. The blade-backing member 570 prevents the toner T from entering between the rubber-supporting section 560*b* and the housing 540 and also presses the rubber section 560*a* from the back thereof towards the developing roller 510 to press the rubber section 560*a* against the developing roller 510.

The end of the rubber section 560*a* of the restricting blade 560 opposite from the end that is being supported by the blade-supporting metal plates 562, i.e., the tip end, is not placed in contact with the developing roller 510; rather, a section at a predetermined distance from the tip end is placed in contact with the developing roller 510 with some breadth. That is, the rubber section 560*a* of the restriction blade 560 does not abut against the developing roller 510 at its edge, but abuts against the roller 510 around its central portion. Further, the restriction blade 560 is arranged so that its tip end faces towards the upstream side of the rotating direction of the developing roller 510, and thus, makes a so-called "counter-abutment" with respect to the roller 510.

It should be noted that the abutting position at which the rubber section 560*a* of the restriction blade 560 abuts against the developing roller 510 is below the central axis of the developing roller 510 and is also below the central axis of the toner-supplying roller 550.

In the yellow developing device 54 structured as above, the toner-supplying roller 550 supplies the toner T contained in the first containing section 530 and the second containing section 535 to the developing roller 510. With the rotation of the developing roller 510, the toner T, which has been supplied to the developing roller 510, reaches the abutting position where the rubber section 560*a* of the restriction blade 560 abuts against the roller 510. Then, as the toner T passes the abutting position, the toner is charged and its thickness is restricted.

With further rotation of the developing roller 510, the toner T on the developing roller 510, whose layer thickness has been restricted, reaches the developing position opposing the photoconductor 20. Then, under the alternating electric field, the toner T is used at the developing position for developing the latent image formed on the photoconductor 20.

The toner T on the developing roller 510, which has passed the developing position due to further rotation of the developing roller 510, passes the upper seal 521 (described further below) and is collected into the developing device without being scraped off by the upper seal 521.

Overview of Configuration of Sealing Unit

Next, an overview of a configuration of the sealing unit will be described with reference to FIG. 4 through FIG. 7.

Figure 4:
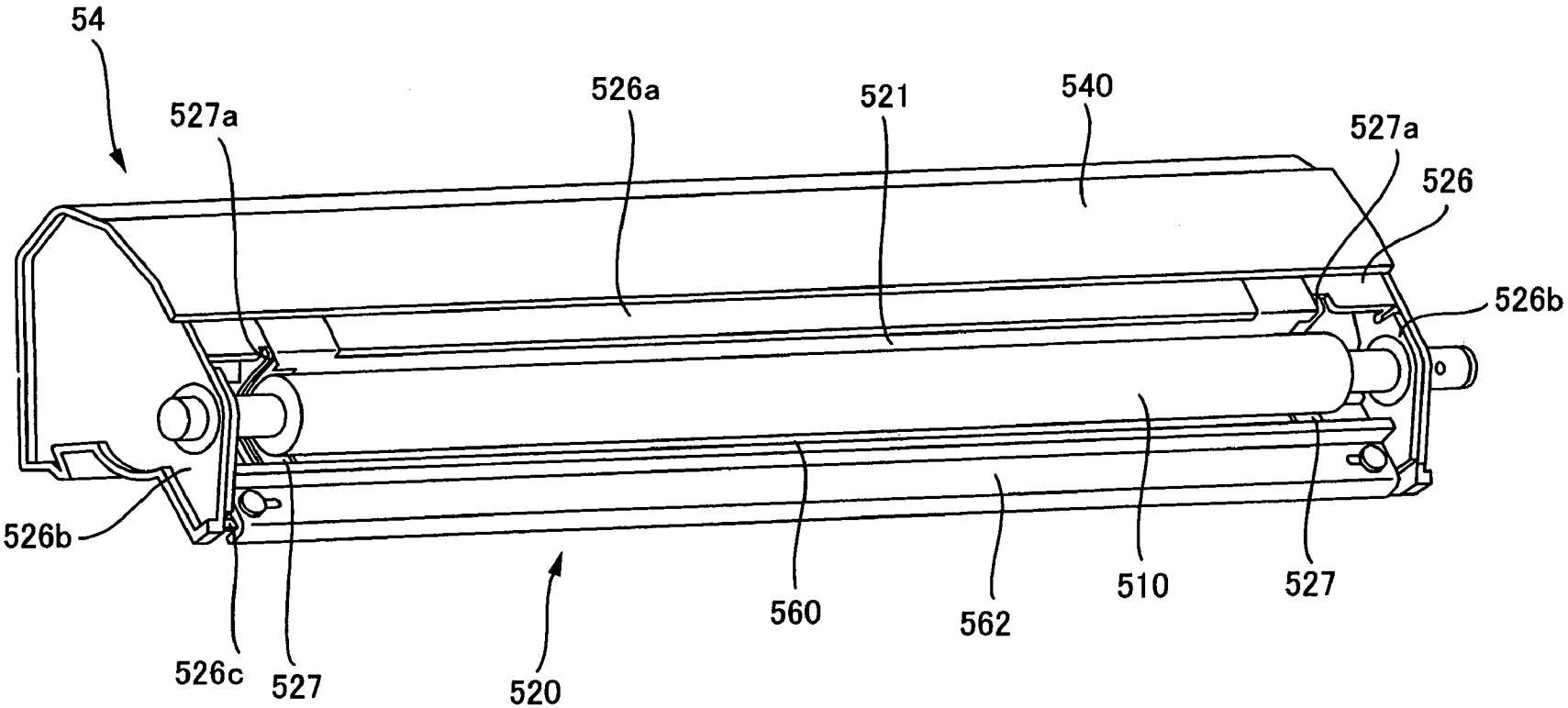
FIG. 4 is a perspective view of a yellow developing device 54 viewed from the side of a developing roller.
Figure 5:
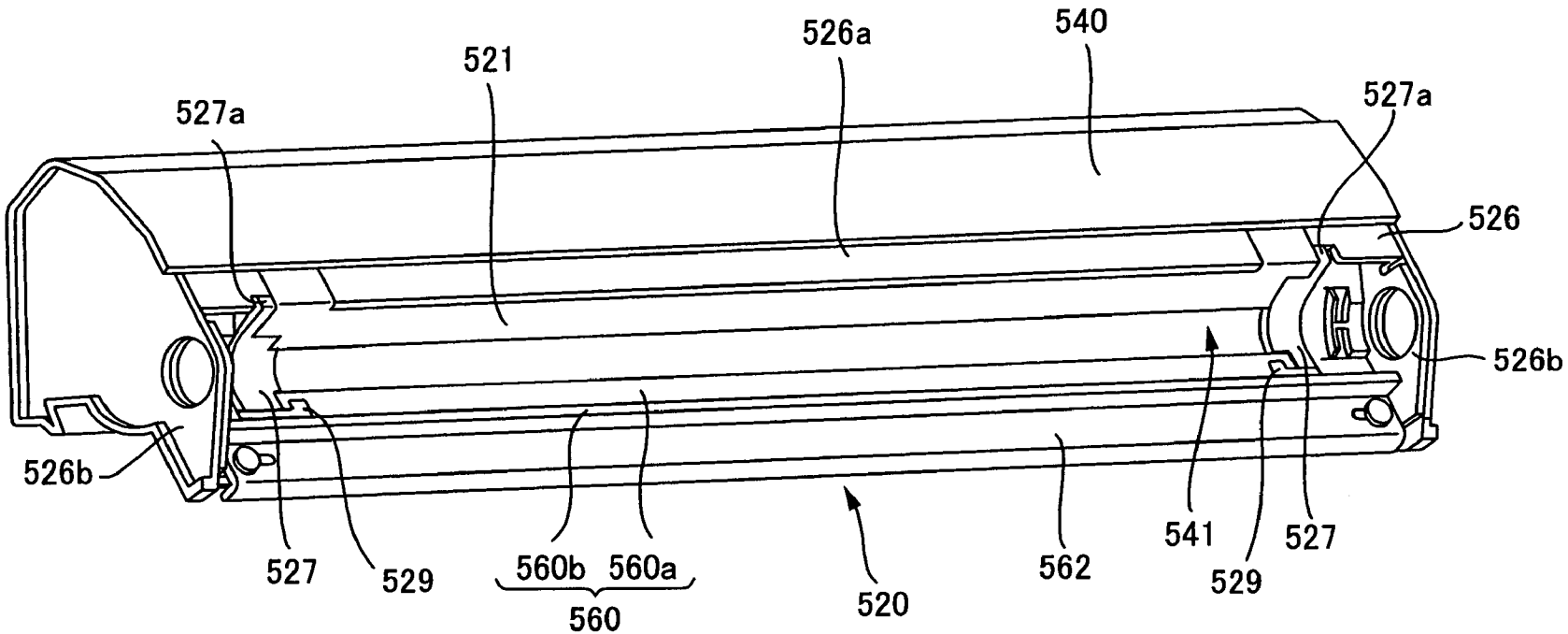
FIG. 5 is a perspective view showing a state in which the developing roller has been taken off.
Figure 6:
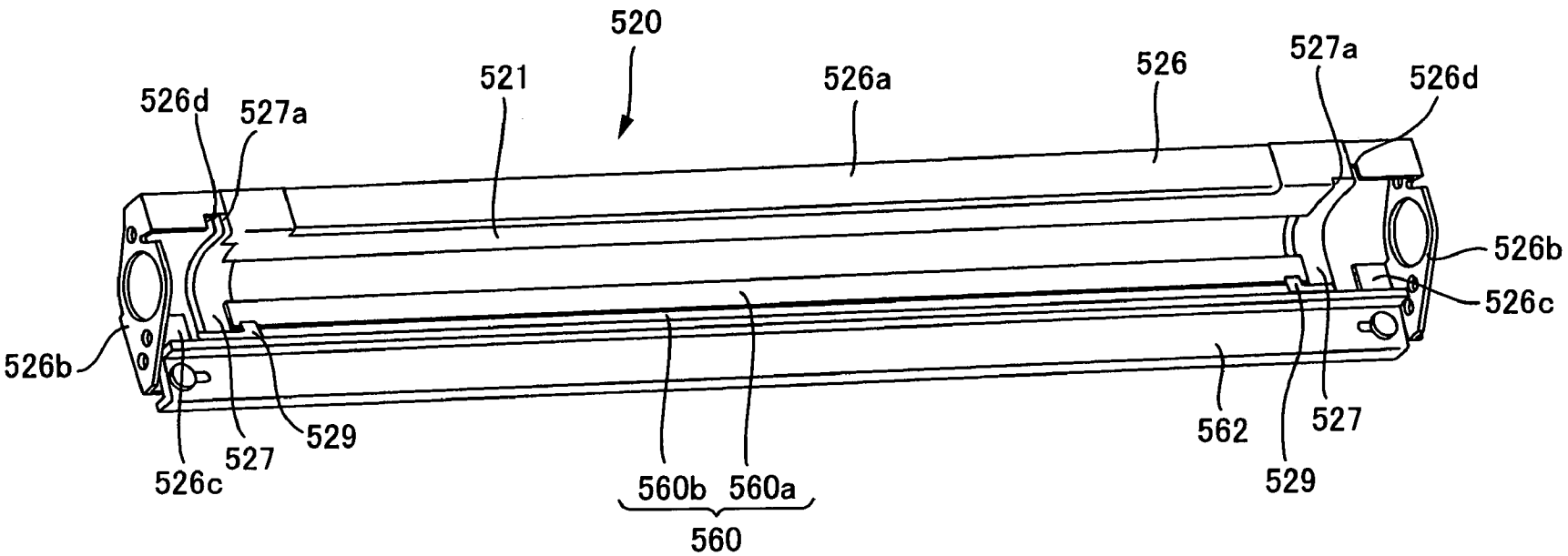
FIG. 6 is a perspective view showing a sealing unit.
Figure 7:
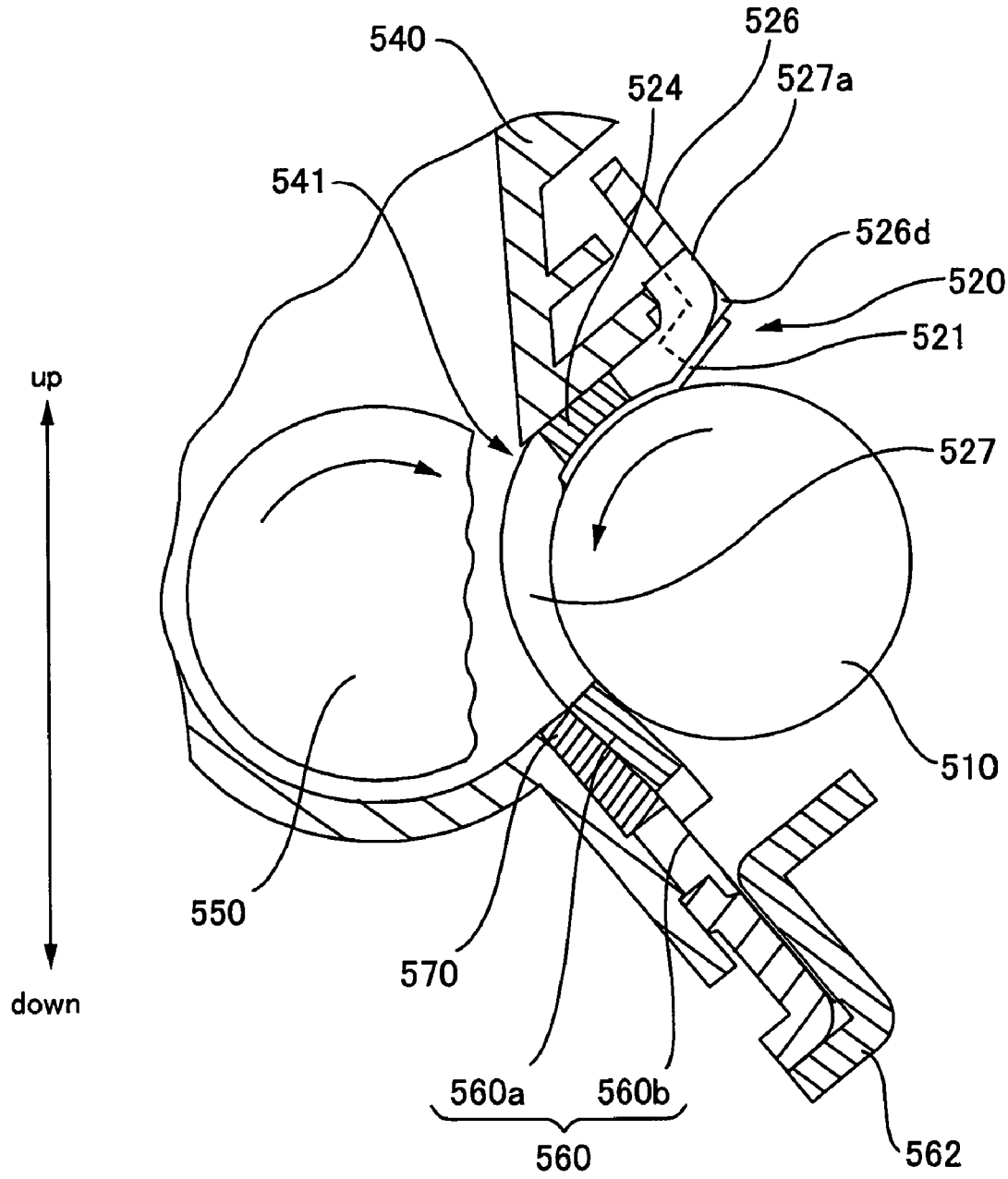
FIG. 7 is a section view showing a sealing structure at the opening.

FIG. 4 is a perspective view of the yellow developing device 54 viewed from the side of the developing roller. FIG. 5 is a perspective view showing a state in which the developing roller has been taken off. FIG. 6 is a perspective view showing a sealing unit. FIG. 7 is a section view showing a sealing structure at the opening.

As shown in FIG. 4, FIG. 5, and FIG. 6, the sealing unit 520 has an upper seal 521, a restriction blade 560, a sealing frame 526, and two end seals 527. The upper seal 521 is for preventing the toner from spilling from between the developing roller 510 and a portion of the housing 540 that forms the upper edge section of the opening 541. The restriction blade 560 functions as to prevent the toner from spilling from between the developing roller 510 and a portion of the housing 540 that forms the lower edge section of the opening 541 (see FIG. 5). The sealing frame 526 is a member to which the upper seal 521 and the restriction blade 560 are attached, and the sealing frame 526, as well as the upper seal 521 and the restriction blade, are fixed to the housing 540 as a single unit. The end seals 527 are fixed to the rubber-supporting section 560*b* of the restriction blade 560 and are for preventing the toner T from spilling in the axial direction of the developing roller 510 at both ends of the developing roller 510.

Further, the sealing unit 520 is also provided with seal-assisting members 529 that are for pressing the end seals 527 against the end surfaces of the restriction blade 560. The seal-assisting members 529 are described in detail further below.

Further, as shown in FIG. 6, the sealing frame 526 has an axial-direction frame section 526*a*, frame side sections 526*b*, and supporting-metal-plate fixing sections 526*c*. The axial-direction frame section 526*a* is provided along the axial direction of the developing roller 510. The frame side sections 526*b* are provided on the left and right by bending up both ends of the axial-direction frame section 526*a*. The supporting-metal-plate fixing sections 526*c* are each formed by bending the lower section of the left-and-right frame side sections 526*b* inwards, and they are for fixing the blade-supporting metal plate 562 thereon.

The upper seal 521 is adhesively attached to the axial-direction frame section 526*a*, and abuts against the portion of the housing 540 that forms the upper edge section of the opening 541. The frame side sections. 526*b* on the left and right are arranged such that they are in opposition to side sections of the housing 540 where bearings for retaining the developing roller 510 are formed. When the blade-supporting metal plate 562, to which the restriction blade 560 has been fixed, is attached between the supporting-metal-plate fixing sections 526*c* on the left and right, the sealing frame 526 becomes a frame-like member that abuts against the housing 540 along the opening 541, and the sealing frame 526 is fixed to the housing 540 from the side of the side sections 526*b*.

The end seals 527 are adhesively attached to the end surfaces of the rubber section 560*a* of the restriction blade 560 with double-faced tapes. The restriction blade 560 and the end seals 527 are tightly pressed against each other by the seal-assisting members 529. Therefore, it is possible to certainly prevent the toner from spilling from the boundary sections between the end surfaces of the rubber section 560*a* and the end seals 527. It should be noted that this is described in detail further below.

The end seals 527 are provided such that they abut against regions at the ends of the developing roller 510 where toner is not bore (in other words, the "toner non-bearing regions" at the ends of the developing roller 510) when the developing roller 510 is attached. Further, the width of each end seal 527 is such that the end seals 527 extend more outward than the ends of the developing roller 510 when the developing roller 510 is attached, and both ends of the developing roller 510 are located more inward than the outer ends of the two end seals 527.

Since no toner is bore at the toner non-bearing regions, a larger frictional resistance is applied to the components that abut against those regions compared to toner-bearing regions where toner is bore. For this reason, the end seals are formed of nonwoven fabric, such as felt, which is a material that has appropriate elasticity, that is less prone to causing shearing deformation compared to urethane etc., and that has a relatively low friction coefficient.

Further, as shown in FIG. 7, when the sealing frame 526, to which the restriction blade 560 has been attached, is attached to the housing 540, the end seals 527 are arranged along a portion of the housing 540 that is formed to oppose the outer circumferential surface of the developing roller 510.

Details on the Sealing Structure in the Vicinity of the Ends

Next, details on the sealing structure in the vicinity of the ends of the developing roller 510 will be described with reference to FIG. 8 through FIG. 13.

In particular, detailed description is made below regarding how the end seals 527, the restriction blade 560, and the seal-assisting members 529 are assembled and how they prevent the toner from spilling in the vicinity of the ends of the developing roller 510.

Figure 12:
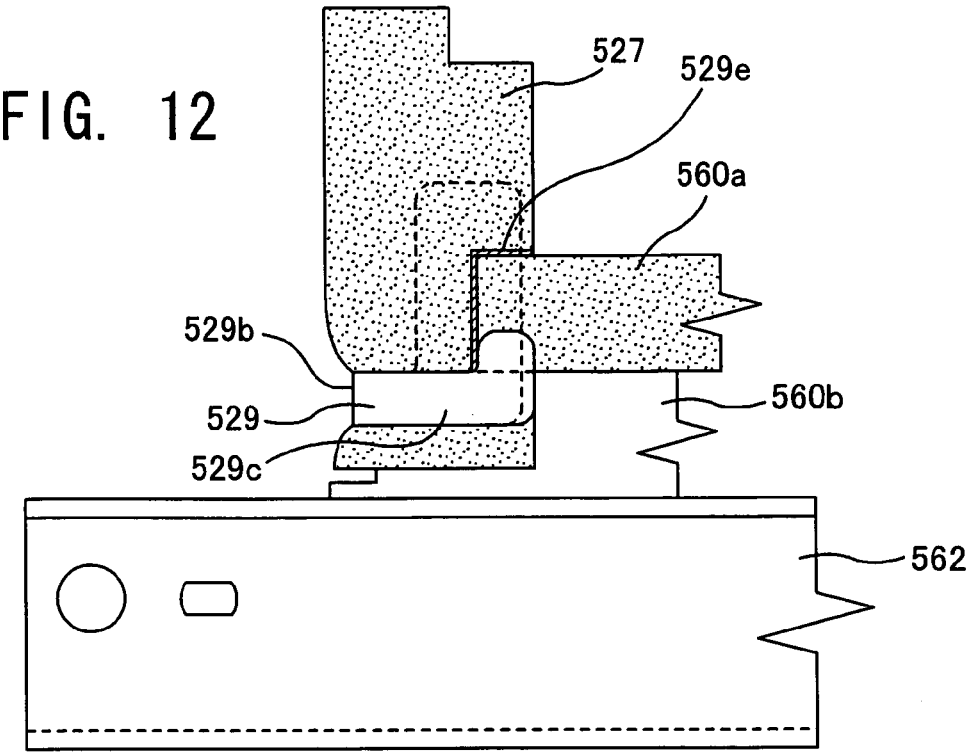
FIG. 12 is a diagram, viewed from the side of the developing roller 510, showing a state in which the end seals 527, the restriction blade 560, the blade-supporting metal plate 562, and also the seal-assisting members have been assembled together.
Figure 13:
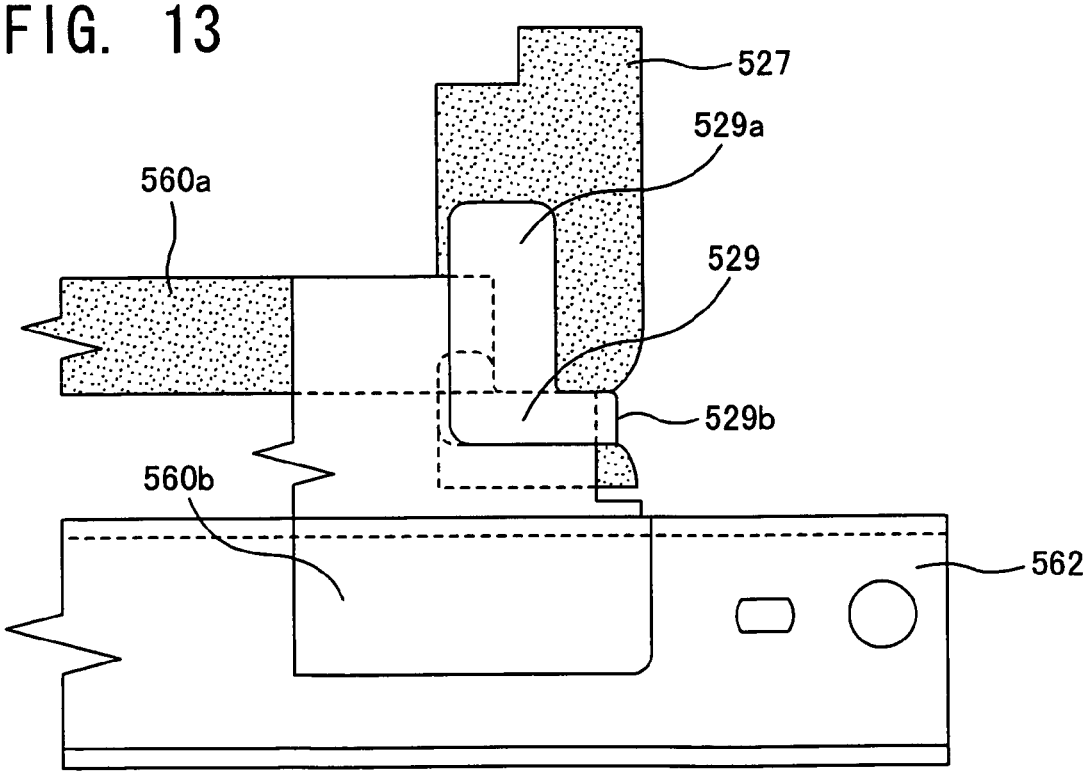
FIG. 13 is a diagram, viewed from the side opposite from the developing roller 510, showing a state in which the end seals 527, the restriction blade 560, the blade-supporting metal plate 562, and also the seal-assisting members have been assembled together.

FIG. 8 is a diagram showing the structure of an end seal 527. FIG. 9 is a diagram showing the restriction blade 560 and the blade-supporting metal plate 562. FIG. 10 is a diagram showing a seal-assisting member 529. FIG. 11 is a diagram, viewed from the side of the developing roller 510, showing a state in which the end seals 527, the restriction blade 560, and the blade-supporting metal plate 562 have been assembled together. FIG. 12 is a diagram, viewed from the side of the developing roller 510, showing a state in which the end seals 527, the restriction blade 560, the blade-supporting metal plate 562, and also the seal-assisting members have been assembled together. FIG. 13 is a diagram, viewed from the side opposite from the developing roller 510, showing a state in which the end seals 527, the restriction blade 560, the blade-supporting metal plate 562, and also the seal-assisting members have been assembled together.

Below, the yellow developing device 54 is described as an example, but the same applies for the other developing devices. Further, the sealing structure of only one end of the yellow developing device 54 is described as an example, but the same applies for the sealing structure of the other end.

Below, the structure of the end seal 527, the restriction blade 560, the blade-supporting metal plate 562, and the seal-assisting member 529 is first described in detail individually. Then, description will be made on how these components are assembled together.

<Structure of End Seal 527>

First, the structure of the end seal 527 is described with reference to FIG. 8. As described above, the end seal 527 is made, for example, of felt, and thus, the material from which it is made is different from that of the rubber section 560*a* of the restriction blade 560. Further, the end seal 527 is shaped as shown in FIG. 8.

The end seal 527 before it is assembled to the sealing unit 520, that is, the end seal 527 as a component part, is thicker than the rubber section 560*a*, and the coefficient of elasticity of the end seal 527 is smaller than that of the rubber section 560*a*.

As shown in FIG. 8, the end seal 527 has a recess 527*b* cut out like a hollow. The recess 527*b* has a first surface 527*c* formed in the axial direction of the developing roller 510, and a second surface 527*d* formed in the direction perpendicular to the axial direction. As described further below, the recess 527*b* is provided for allowing the end of the rubber section 560*a* of the restriction blade 560 to fit in.

<Structure of Restriction Blade 560 and Blade-supporting Metal Plate 562>

Next, the structure of the restriction blade 560 and the blade-supporting metal plate 562 will be described with reference to FIG. 9.

The restriction blade 560 is fixed to the blade-supporting metal plate 562. More specifically, the blade-supporting metal plate 562 and the rubber-supporting section 560*b* of the restriction blade 560 are fixed to one another by means of spot welding, for example.

<Structure of Seal-assisting Member 529>

Next, the structure of the seal-assisting member 529 will be described with reference to FIG. 10.

The seal-assisting member 529 is a component for pressing the end seal 527 against the end surface of the restriction blade 560, and is made of a flexible material, for example, a film-like material such as PET film.

One end 529*c* of the seal-assisting member 529 has an L-like shape and is fixed to the restriction blade 560 as described further below. The other end 529*a* of the seal-assisting member 529 has an L-like shape that is larger than the end 529*c* and is fixed to the end seal 527. It should be noted that means such as double-faced tapes and adhesives may suitably be adopted for the fixing. Further, the shape of the end 529*c* and the other end 529*a* is not limited to the L-like shape, and other shapes such as a T-like shape may be adopted.

A folding section 529*b* is provided between the end 529*c* and the other end 529*a* of the seal-assisting member 529. The width of the folding section 529*b* is made smaller than the width of the end 529*c* and the other end 529*a*. The folding section 529*b* is where the seal-assisting member 529 is folded when it is assembled to the end seal 527 and the restriction blade 560.

The above is a description on the structure of the end seal 527, the restriction blade 560, the blade-supporting metal plate 562, and the seal-assisting member 529. Now, description will be made on how these components are assembled together.

<Assembling the End Seal 527 to the Restriction Blade 560 (and the Blade-supporting Metal Plate 562)>

First, with reference to FIG. 11, description will be made on how the end seal 527 is assembled to the restriction blade 560 (and the blade-supporting metal plate 562).

The longitudinal direction of the rubber section 560*a* of the restriction blade 560 is arranged in the axial direction of the developing roller 510. The ends in the axial direction of the rubber section 560*a* are fitted into the recess 527*b* of each end seal 527.

The end surface 560*d* of the rubber section 560*a* fitted into the recess 527*b* is placed in abutment with the second surface 527*d* of the end seal 527, and a portion of a tip-end side surface 560*e* of the restriction blade 560 in the circumferential direction of the developing roller 510 is placed in contact with the first surface 527*c*, and they are adhesively attached together with a double-faced tape 529*e*, for example.

Since the rubber section 560*a* and the end seal 527 are placed in contact with each other in two surfaces (planes) that are perpendicular to one other, these contact sections link the outer section of the housing 540 and the side of the developing roller 510 in a linear fashion, and thus no joint is formed. Therefore, the toner it less prone to spilling from these sections.

<Assembling the Seal-assisting Member 529>

Next, with reference to FIG. 12 and FIG. 13, description will be made on how the seal-assisting member 529 is assembled to the structure in which the end seal 527 has been assembled to the restriction blade 560 (and the blade-supporting metal plate 562).

As shown in FIG. 12, the seal-assisting member 529 is attached in a state where it folded at the folding section 529*b* in order to press the end seal 527 against the end surface of the rubber section 560*a*.

The end 529*c* of the seal-assisting member 529 is attached to the rubber section 560*a* of the restriction blade 560 with a double-faced tape as shown in FIG. 12. More specifically, the end 529*c* of the seal-assisting member 529 is adhesively attached with a double-faced tape such that it extends over both the rubber section 560*a* and the end seal 527.

The other end 529*a* of the seal-assisting member 529 is attached to the rubber-supporting section 560*b* of the restriction blade 560 with a double-faced tape as shown in FIG. 13. More specifically, the other end 529*a* of the seal-assisting member 529 is adhesively attached with a double-faced tape such that is extends over both the rubber-supporting section 560*b* and the end seal 527.

That is, the seal-assisting member 529 is assembled such that its end 529*c* is fixed to the restriction blade 560, its folding section 529*b* is folded at an intermediate section to surround the side end of the end seal 527, and its other end 529*a* is fixed to the rubber-supporting section 560*b*.

In assembling the seal-assisting member 529, tension is applied to the seal-assisting member 529. The end seal 527 is therefore compressed and deformed such that the section in the side-end surface of the end seal 527 against which the folding section 529*b* abuts is depressed. By assembling the seal-assisting member 529 in this way, it is possible to visually confirm that the end seal 527 has been made to abut against the rubber section 560*a* firmly.

Further, as described above, the width of the folding section 529*b* is smaller than the width of the end 529*c* and the other end 529*a*. Therefore, the folding section 529*b* becomes linear when tension is applied to the seal-assisting member 529, and thus, slackness in the seal-assisting member 529 can be reduced.

As described above, FIG. 12 is a diagram, viewed from the side of the developing roller 510, showing a state in which the end seals 527, the restriction blade 560, the blade-supporting metal plate 562, and also the seal-assisting members have been assembled together. As appreciated from this figure, when the sealing unit 520 is assembled to the housing 540, the surface of the end seal 527 on the front side of the paper face of FIG. 12 abuts against the developing roller 510. Note that the seal-assisting member 529, and in particular, the end 529*c* of the seal-assisting member 529, is attached to a position where it does not come into contact with the developing roller 510. In this way, the developing roller 510 will not come into contact with the seal-assisting member 529 even when the developing roller 510 rotates. Therefore, the seal-assisting member 529 will not peel off by getting pulled by the frictional force of the developing roller 510.

Function of the Seal-assisting Member 529

Next, the function of the seal-assisting member 529 is described with reference to FIG. 14.

Figure 14:
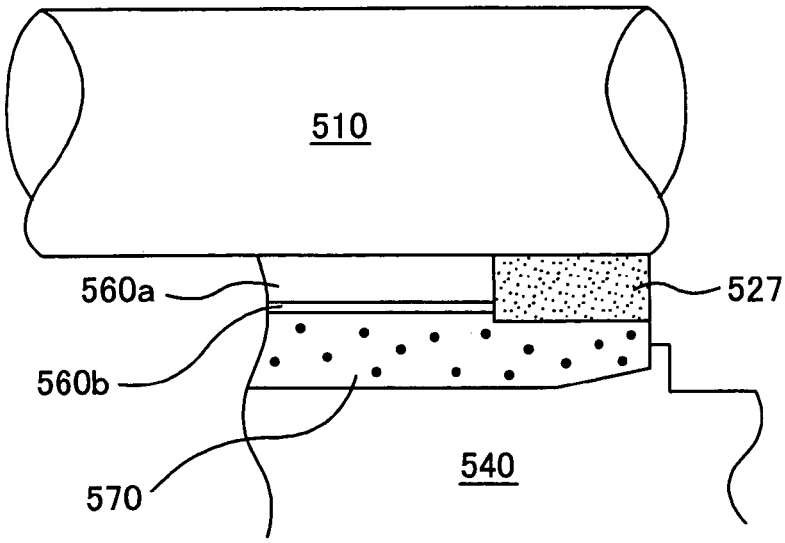
FIG. 14 is diagram, viewed from the tip-end side of the restriction blade 560, showing the arrangement of the developing roller 510, the restriction blade 560, the end seal 527, and so forth.
Figure 15:
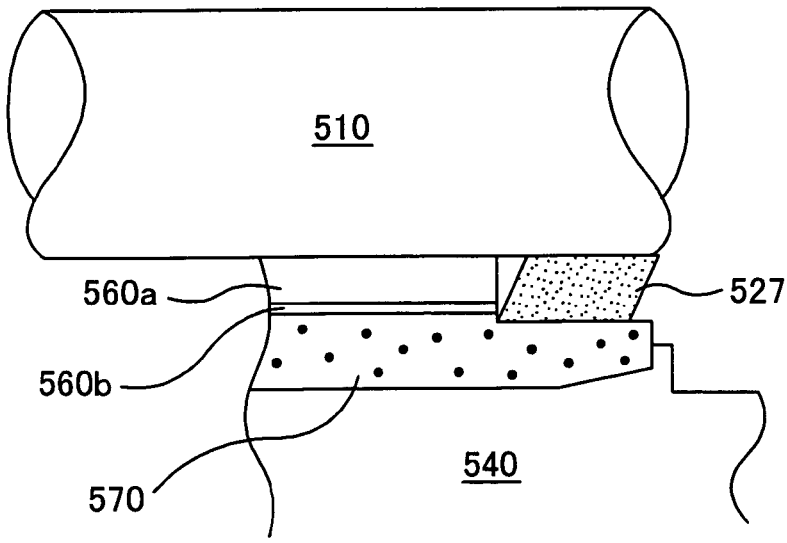
FIG. 15 is a diagram showing an example in which the seal-assisting member 529 is not provided.

FIG. 14 is diagram, viewed from the tip-end side of the restriction blade 560, showing the arrangement of the developing roller 510, the restriction blade 560, the end seal 527, and so forth. FIG. 15 is a diagram showing an example in which the seal-assisting member 529 is not provided.

The positional relationship among the developing roller 510, the blade-backing member 570, the restriction blade 560, and the end seal 527 when the sealing unit 520 is assembled together with the housing (frame) 540 and the developing roller 510 is as shown in FIG. 14. It should be noted that the blade-backing member 570, which serves as an elastic member, is fixed to the housing 540 with, for example, a double-faced tape, and the blade-backing member 570 is arranged between the housing 540 and the restriction blade 560/the end seal 527 to prevent the toner from spilling in cooperation with the restriction blade 560 and the end seal 527.

As described above, before the sealing unit 520 is assembled to the housing 540, the restriction blade 560 of the sealing unit 520 is in an unbent state, and the end seals 527 are not compressed.

When the sealing unit 520 is assembled with the housing (frame) 540 and the developing roller 510, the restriction blade 560 is made to abut against the developing roller 510 in a bent state, and the end seals 527 abut against the developing roller 510 in a compressed state, thereby preventing the toner from spilling, in cooperation with the blade-backing member (elastic member) 570 (see FIG. 3, FIG. 7, and FIG. 14).

More specifically, the restriction blade 560 is in a state where the rubber section 560*a* abuts against the developing roller 510 and bends towards the opposite side from the developing roller 510, and the restriction blade 560 compresses the blade-backing member 570. On the other hand, the end seals 527 are compressed by abutting against the developing roller 510, and they also compress the blade-backing member 570.

As described above, the restriction blade 560 and the end seals 527 are components that have different structures, and they differ, for example, in thickness and material. Therefore, when the sealing unit 520 is assembled with the housing (frame) 540 and the developing roller 510, the compression force and the pressing force exerted on the restriction blade 560 and the end seals 527 differ. Therefore, the way these components deform and the degree of deformation also differ.

Therefore, even though the restriction blade 560 and the end seals 527 are tightly pressed together before the sealing unit 520 is assembled to the housing 540, a gap is likely to be formed between the restriction blade 560 and each end seal 527 once the sealing unit 520 is assembled. More specifically, a gap is likely to be formed between the end surface 560*d* of the rubber section 560*a* and the second surface 527*d*, which are adhesively attached to one another with a double-faced tape, and also, a gap is likely to be formed between the tip-end side surface 560*e* of the rubber section 560*a* and the first surface 527*c*, which are also adhesively attached to one another with a double-faced tape (see FIG. 11).

If the seal-assisting members 529 are not provided, then when the sealing unit 520 is assembled with the housing 540 and the developing roller 510, the end seals 527 deform, for example, in such a manner as to tilt outwards in the axial direction of the developing roller 510 as shown in FIG. 15, and therefore, there arises a possibility that a gap is formed between the restriction blade 560 and each end seal 527.

On the other hand, according to the present embodiment, the seal-assisting members 529 are provided, and the end seals 527 are pressed against the end surfaces of the restriction blade 560 (i.e., the end surfaces of the rubber section 560*a*) by these seal-assisting members 529.

Therefore, according to the present embodiment, no gap will be formed between the restriction blade 560 and each end seal 527, even when the sealing unit 520 is assembled with the housing 540 and the developing roller 510 and the restriction blade 560 and the end seals 527 are deformed in a different manner. As a result, it becomes possible to certainly prevent the toner from spilling.

Other Embodiments

Above, a developing device etc. according to the present invention was described based on an embodiment thereof. The foregoing embodiment of the invention, however, is merely for facilitating understanding of the present invention, and is not to limit the scope of the present invention. It goes without saying that the present invention may be altered and/or modified without departing from the gist thereof, and that the present invention includes its equivalents.

In the foregoing embodiment, a full-color laser-beam printer of the intermediate-transferring type was described as an example of an image forming apparatus. The present invention, however, is also applicable to various other types of image forming apparatuses such as full-color laser-beam printers other than the intermediate-transferring type, monochrome laser-beam printers, photocopiers, and facsimile machines.

Further, the developing device according to the present invention is not to be limited to a device having the structure described in detail above, but the present invention is equally applicable to any kind of developing device as long as it at least requires a sealing structure for sealing a gap formed between a housing and a developing roller that moves while bearing toner.

Further, it is possible to use, for the developing roller, any kind of material that is capable of structuring the developing roller, such as magnetic material, nonmagnetic material, conductive material, insulating material, metal, rubber, and resin. For example, it is possible to use: metal such as aluminum, nickel, stainless steel, and iron; rubber such as natural rubber, silicone rubber, polyurethane rubber, butadiene rubber, chloroprene rubber, neoprene rubber, and NBR; and resin such as polystyrene resin, vinyl chloride resin, polyurethane resin, polyethylene resin, methacrylate resin, and nylon resin. Further, it goes without saying that the upper layer of these materials can be coated.

In this case, as the coating material, it is possible to use, for example: polyethylene, polystyrene, polyurethane, polyester, nylon, or acrylic resin. Further, the developing roller can be formed into any shape/structure such as an inelastic body, an elastic body, a single-layer structure, a multi-layer structure, a film, or a roller. Further, the developer is not limited only to toner, but other kinds of developer such as two component developer in which a carrier is mixed can be used.

Further, in the foregoing embodiment: a sealing unit 520 was provided with the restriction blade 560 and the end seal 527, the restriction blade 560 being in an unbent state and the end seal 527 abutting against the end surface of the restriction blade 560 in a non-compressed state before the sealing unit 520 is assembled with a housing 540 and the developing roller 510; and when the sealing unit 520 was assembled with the housing 540 and the developing roller 510, the restriction blade 560 was brought into a bent state to abut against the developing roller 510 and the end seal 527 was brought into a compressed state to prevent the developer from spilling. This, however, is not a limitation.

For example, even if a sealing unit 520 is not provided, a restriction blade 560, which is in an unbent state, and an end seal 527, which abuts against the end surface of the restriction blade 560 in a non-compressed state, may be assembled with the housing 540 and the developing roller 510 such that the restriction blade 560 is brought into a bent state to abut against the developing roller 510 and the end seal 527 is brought into a compressed state to prevent the developer from spilling.

Further, in the foregoing embodiment: the restriction blade 560 and one side of the end seal 527 abutted against the developing roller 510; the restriction blade 560 and the other side of the end seal 527 abutted against the housing 540 with an elastic member being arranged between the housing 540, and the restriction blade 560 and the other side of the end seal 527; and before the sealing unit 520 was assembled with the housing 540 and the developing roller 510, the thickness of the restriction blade 560 and the thickness of the end seal 527 differed from one another. This, however, is not a limitation, and the thickness of the restriction blade 560 and the thickness of the end seal 527 before the sealing unit 520 is assembled with the housing 540 and the developing roller 510 may be the same.

It is, however, particularly advantageous to provide a seal-assisting member 529 because a gap is likely to be formed between the end surface of the restriction blade 560 and the end seal 527 when the restriction blade 560 is bent and the end seal 527 is compressed in cases where the thickness of the restriction blade 560 and the thickness of the end seal 527 before the sealing unit 520 is assembled with the housing 540 and the developing roller 510 differ from one another.

Further, in the foregoing embodiment: the restriction blade 560 and one side of the end seal 527 abutted against the developing roller 510; the restriction blade 560 and the other side of the end seal 527 abutted against the housing 540 with an elastic member being arranged between the housing 540, and the restriction blade 560 and the other side of the end seal 527; and the material from which the restriction blade 560 is made and the material from which the end seal 527 is made differed from one another. This, however, is not a limitation, and the material from which the restriction blade 560 is made and the material from which the end seal 527 is made may be similar.

It is, however, particularly advantageous to provide a seal-assisting member 529 because a gap is likely to be formed between the end surface of the restriction blade 560 and the end seal 527 when the restriction blade 560 bends and the end seal 527 is compressed in cases where the material from which the restriction blade 560 is made and the material from which the end seal 527 is made differ from one another.

Further, in the foregoing embodiment, the seal-assisting member 529 was made of a flexible material. This, however, is not a limitation, and the seal-assisting member 529 may be made of a non-flexible material.

It is, however, advantageous to make the seal-assisting member 529 out of a flexible material because it becomes possible to fold the seal-assisting member 529 and wrap it along the outer shape of the end seal 527, without forming any gap, upon assembling the seal-assisting member 529.

Further, in the foregoing embodiment, one end of the seal-assisting member 529 was fixed to the restriction blade 560, and the other end was fixed to the end seal 527. This, however, is not a limitation.

For example, the seal-assisting member 529 may be structured such that one end of the seal-assisting member 529 is fixed to the restriction blade 560, it is folded at an intermediate section to surround the side end of the end seal 527, and the other end is also fixed to the restriction blade 560.

Further, in the foregoing embodiment, one end of the seal-assisting member 529 was fixed to the restriction blade 560, the seal-assisting member 529 was folded at an intermediate section to surround the side end of the end seal 527, and the other end was fixed to the end seal 527. This, however, is not a limitation.

For example, one end of the seal-assisting member 529 may be fixed to the restriction blade 560 and the other end may be fixed to the end seal 527 without folding the seal-assisting member 529 at an intermediate section.

However, by adopting the structure in which one end of the seal-assisting member 529 is fixed to the restriction blade 560, the seal-assisting member 529 is folded at an intermediate section to surround the side end of the end seal 527, and the other end is fixed to the end seal 527, it becomes possible to cause the end seal 527 to abut against the side end surface of the restriction blade 560 more effectively.

Further, in the foregoing embodiment, the width of a folding section of the seal-assisting member 529 which is folded to surround the side end of the end seal 527 is smaller than the width of the one end and the width of the other end of the seal-assisting member 529. This, however, is not a limitation.

For example, the folding section may have the same width as the one end and the other end.

However, by making the width of a folding section of the seal-assisting member 529 smaller than the width of the one end and the width of the other end of the seal-assisting member 529, the seal-assisting member 529 becomes linear when tension is applied thereto and slackness in the seal-assisting member 529 is less prone to occurring, even if there is somewhat of a misalignment in position. Therefore, it becomes possible to cause the end seal 527 to abut against the side end surface of the restriction blade 560 even more effectively.

Further, in the foregoing embodiment, the seal-assisting member 529 compressed and deformed the end seal 527 with the folding section. This, however, is not a limitation, and the seal-assisting member 529 may be structured such that it does not compress and deform the end seal 527 with its folding section.

However, by causing the seal-assisting member 529 to compress and deform the end seal 527 with the folding section, it becomes possible to confirm, at a glance, that a compression force is being applied to the end seal 527, and easily get hold of the compression state of the end seal 527. Therefore, the possibility that defective items are manufactured can be reduced, and assembly inspections become easy.

Further, in the foregoing embodiment, the seal-assisting member 529 had an L-shaped section or a T-shaped section in at least either one of the one end and the other end. This, however, is not a limitation, and the one end or the other end does not have to have an L-shaped section or a T-shaped section.

It is, however, advantageous for the seal-assisting member 529 to have an L-shaped section or a T-shaped section in at least either one of the one end and the other end because it becomes possible to make the area for fixing the end of the seal-assisting member 529 large, and therefore stabilize the fixing state thereof.

Further, in the foregoing embodiment, one end of the seal-assisting member 529 was fixed to the restriction blade 560 with a double-faced tape. This, however, is not a limitation. For example, one end of the seal-assisting member 529 may be fixed to the restriction blade 560 with an adhesive.

It is, however, advantageous to fix one end of the seal-assisting member 529 to the restriction blade 560 with a double-faced tape because it becomes possible to assemble the developing device quickly and certainly.

Further, in the foregoing embodiment, the seal-assisting member 529 was made of PET film. The seal-assisting member 529, however, does not necessarily have to be made of PET film.

It is, however, advantageous if the seal-assisting member 529 is made of PET film because it becomes possible to assemble the seal-assisting member 529 easily as well as cause the end seal 527 to abut against the side end surface of the restriction blade 560 effectively.

Further, in the foregoing embodiment, the seal-assisting member 529 was provided in a position where it does not come into contact with the developing roller 510. The seal-assisting member 529, however, may be arranged in a position where it comes into contact with the developing roller 510.

It is, however, advantageous to provide the seal-assisting member 529 in a position where it does not come into contact with the developing roller 510, because the seal-assisting member 529 will not roll up or peel off by the frictional force caused by coming into contact with the developing roller 510.

Configuration of Computer System Etc.

Next, an embodiment of a computer system, a computer program, and a storage medium having a computer program recorded thereon, which serve as an example of an embodiment of the present invention, is described with reference to the drawings.

Figure 16:
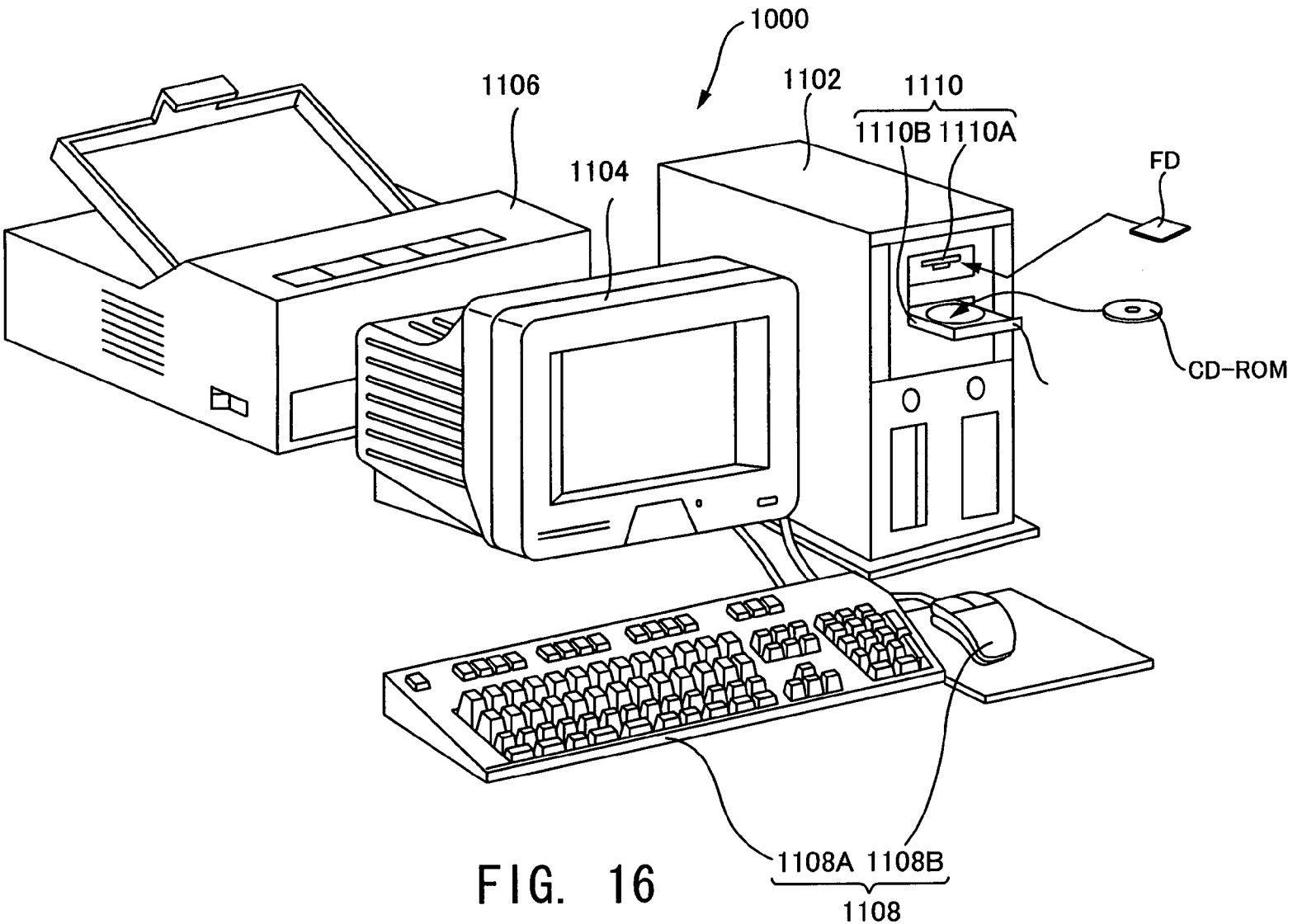
FIG. 16 is an explanatory diagram showing the external configuration of a computer system.

FIG. 16 is an explanatory diagram showing an external structure of a computer system. The computer system 1000 includes a computer 1102, a display device 1104, a printer 1106, an input device 1108, and a reading device 1110. In this embodiment, the computer 1102 is accommodated in a mini-tower type housing, but this is not a limitation.

A CRT (cathode ray tube), a plasma display, or a liquid crystal display device, for example, is generally used as the display device 1104, but this is not a limitation. The printer described above is used as the printer 1106.

In this embodiment, a keyboard 1108A and a mouse 1108B are used as the input device 1108, but this is not a limitation. In this embodiment, a flexible disk drive device 1111A and a CD-ROM drive device 1110B are used as the reading device 1110, but the reading device is not limited to these, and other devices such as an MO (magneto optical) disk drive device or a DVD (digital versatile disk) may be used.

Figure 17:
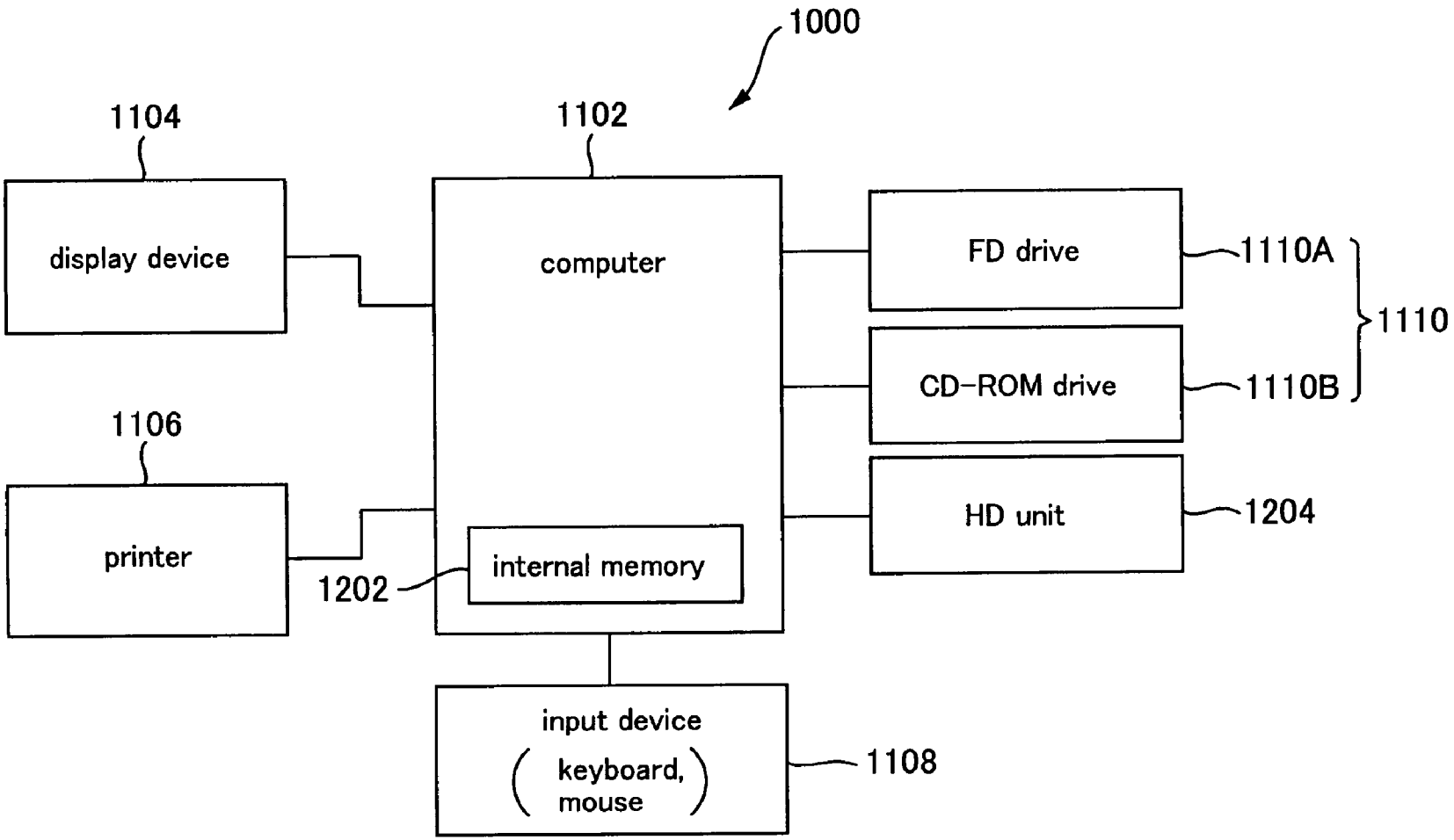
FIG. 17 is a block diagram showing the configuration of the computer system shown in FIG. 16.

FIG. 17 is a block diagram showing a configuration of the computer system shown in FIG. 16. Further provided are an internal memory 1202, such as a RAM inside the housing accommodating the computer 1102, and an external memory such as a hard disk drive unit 1204.

It should be noted that in the above description, an example in which the computer system is structured by connecting the printer 1106 to the computer 1102, the display device 1104, the input device 1108, and the reading device 1110 was described, but this is not a limitation.

For example, the computer system can be made of the computer 1102 and the printer 1106, and the computer system does not have to include any one of the display device 1104, the input device 1108, and the reading device 1110.

Further, for example, the printer 1106 can have some of the functions or mechanisms of the computer 1102, the display device 1104, the input device 1108, and the reading device 1110.

As an example, the printer 1106 may be configured so as to be provided with an image processing section for carrying out image processing, a displaying section for carrying out various types of displays, and a recording media attach/detach section to and from which recording media storing image data captured by a digital camera or the like are inserted and taken out.

As an overall system, the computer system that is achieved in this way is less prone to causing toner spilling from the developing device, and becomes superior to conventional systems.

What is claimed is:

1. A developing device comprising:

a developer containing section for containing developer;

a developing roller for bearing the developer; a restriction blade for restricting the developer bore by said developing roller;

an end seal for preventing the developer from spilling through a gap between an end of said restriction blade and said developer containing section and for preventing the developer from spilling through a gap between an end of said developing roller and said developer containing section; and a seal-assisting member for pressing said end seal against the end surface of said restriction blade, wherein a sealing unit is provided with said restriction blade and said end seal, said restriction blade being in an unbent state and said end seal abutting against said end surface of said restriction blade in a non-compressed state before said sealing unit is assembled with a housing and said developing roller; and when said sealing unit is assembled with said housing and said developing roller, said restriction blade is brought into a bent state to abut against said developing roller and said end seal is brought into a compressed state to prevent the developer from spilling.

2. A developing device according to claim 1, wherein:

said restriction blade and one side of said end seal abut against said developing roller;

said restriction blade and the other side of said end seal abut against said housing, an elastic member being arranged between said housing, and said restriction blade and the other side of said end seal; and before said sealing unit is assembled with said housing and said developing roller, the thickness of said restriction blade and the thickness of said end seal differ from one another.

3. A developing device according to claim 1, wherein:

said restriction blade and one side of said end seal abut against said developing roller;

said restriction blade and the other side of said end seal abut against said housing, an elastic member being arranged between said housing, and said restriction blade and the other side of said end seal; and the material from which said restriction blade is made and the material from which said end seal is made differ from one another.

4. A developing device comprising:

a developer containing section for containing developer;

a developing roller for bearing the developer; a restriction blade for restricting the developer bore by said developing roller;

an end seal for preventing the developer from spilling through a gap between an end of said restriction blade and said developer containing section and for preventing the developer from spilling through a gap between an end of said developing roller and said developer containing section; and a seal-assisting member for pressing said end seal against the end surface of said restriction blade, wherein one end of said seal-assisting member is fixed to said restriction blade, and the other end of said seal-assisting member is fixed to said end seal, and wherein said one end of said seal-assisting member is fixed to said restriction blade, said seal-assisting member is folded at an intermediate section to surround the side end of said end seal, and said other end of said seal-assisting member is fixed to said end seal.

5. A developing device according to claim 4, wherein the width of a folding section of said seal-assisting member which is folded to surround said side end of said end seal is smaller than the width of said one end and the width of said other end of said seal-assisting member.

6. A developing device according to claim 5, wherein said seal-assisting member compresses and deforms said end seal with said folding section.

7. A developing device comprising:

a developer containing section for containing developer;

a developing roller for bearing the developer; a restriction blade for restricting the developer bore by said developing roller;

an end seal for preventing the developer from spilling through a gap between an end of said restriction blade and said developer containing section and for preventing the developer from spilling through a gap between an end of said developing roller and said developer containing section; and a seal-assisting member for pressing said end seal against the end surface of said restriction blade, wherein one end of said seal-assisting member is fixed to said restriction blade, and the other end of said seal-assisting member is fixed to said end seal, and wherein said seal-assisting member has an L-shaped section or a T-shaped section in at least either one of said one end and said other end.

8. A developing device comprising:

a developer containing section for containing developer;

a developing roller for bearing the developer;

a restriction blade for restricting the developer bore by said developing roller;

an end seal for preventing the developer from spilling through a gap between an end of said restriction blade and said developer containing section and for preventing the developer from spilling through a gap between an end of said developing roller and said developer containing section; and a seal-assisting member for pressing said end seal against the end surface of said restriction blade, wherein:

a sealing unit is provided with said restriction blade and said end seal, said restriction blade being in an unbent state and said end seal abutting against said end surface of said restriction blade in a non-compressed state before said sealing unit is assembled with a housing and said developing roller;

when said sealing unit is assembled with said housing and said developing roller, said restriction blade is brought into a bent state to abut against said developing roller and said end seal is brought into a compressed state to prevent the developer from spilling;

said restriction blade and one side of said end seal abut against said developing roller;

said restriction blade and the other side of said end seal abut against said housing, an elastic member being arranged between said housing, and said restriction blade and the other side of said end seal;

before said sealing unit is assembled with said housing and said developing roller, the thickness of said restriction blade and the thickness of said end seal differ from one another;

the material from which said restriction blade is made and the material from which said end seal is made differ from one another;

said one end of said seal-assisting member is fixed to said restriction blade, said seal-assisting member is folded at an intermediate section to surround the side end of said end seal, and said other end of said seal-assisting member is fixed to said end seal;

the width of a folding section of said seal-assisting member which is folded to surround said side end of said end seal is smaller than the width of said one end and the width of said other end of said seal-assisting member;

said seal-assisting member compresses and deforms said end seal with said folding section;

said seal-assisting member has an L-shaped section or a T-shaped section in at least either one of said one end and said other end;

said seal-assisting member is made of a film-like material; and said seal-assisting member is provided in a position where it does not come into contact with said developing roller.

* * * * *